US011287135B2

(12) United States Patent
Purinton et al.

(10) Patent No.: US 11,287,135 B2
(45) **Date of Patent: *Mar. 29, 2022**

(54) NON-BYPASSABLE CATALYST ASSISTED APPLIANCES

(71) Applicant: Jotul AS, Fredrikstad (NO)

(72) Inventors: Roger W. Purinton, Raymond, ME (US); Shane L. Spencer, Windham, ME (US)

(73) Assignee: JOTUL AS, Fredrikstad (NO)

( * ) Notice: Subject to any disclaimer, the term of this patent is extended or adjusted under 35 U.S.C. 154(b) by 0 days.

This patent is subject to a terminal disclaimer.

(21) Appl. No.: 17/004,413

(22) Filed: Aug. 27, 2020

(65) Prior Publication Data

US 2020/0393133 A1 Dec. 17, 2020

Related U.S. Application Data

(63) Continuation of application No. 15/799,202, filed on Oct. 31, 2017, now Pat. No. 10,788,216.

(Continued)

(51) Int. Cl.
*F24B 1/02* (2006.01)
*F23G 7/07* (2006.01)

(Continued)

(52) U.S. Cl.
CPC ..... *F24B 1/028* (2013.01); *F23B 5/04* (2013.01); *F23B 90/08* (2013.01); *F23G 7/07* (2013.01);

(Continued)

(58) Field of Classification Search
CPC ..... F24B 1/028; F24B 1/006; F24B 5/025; F24B 13/00; F23B 5/04; F23B 5/026;

(Continued)

(56) References Cited

U.S. PATENT DOCUMENTS 4,373,507 A 2/1983 Schwartz et al.
4,458,662 A * 7/1984 Barnett ..... F24B 5/026 110/205

(Continued)

FOREIGN PATENT DOCUMENTS

EP 2166287 A2 2/2009
JP 2011242120 A * 12/2011

(Continued)

OTHER PUBLICATIONS

MF Fire Catalyst Wood Stove Owner's Manual, 25 pages, at least as early as 2013.

(Continued)

*Primary Examiner* — Steven B McAllister
*Assistant Examiner* — Daniel E. Namay
(74) *Attorney, Agent, or Firm* — Heslin Rothenberg Farley & Mesiti P.C.

(57) ABSTRACT

A non-bypassable catalyst assisted appliance includes, for example, a housing having a combustion chamber, a loading door, an air inlet opening, and an exit opening connectable to a flue. A platform defines a non-movable separation in the housing between the combustion chamber and the exit opening. An insulated catalyst combustor is disposed between a top wall of the housing and the platform. When the door of the appliance is closed, gas from the combustion chamber is exhausted and directed along a single flow path horizontally through the insulated catalytic combustor and into the flue. When the door of the appliance is open, gas from the combustion chamber is inhibited from passing through the loading door opening, and ambient air entering the loading door opening and combustion gas from the combustion chamber are exhausted and directed along a single flow path horizontally through the insulated catalytic combustor and into the flue.

30 Claims, 17 Drawing Sheets

Related U.S. Application Data

(60) Provisional application No. 62/415,863, filed on Nov. 1, 2016.

(51) Int. Cl.
*F23B 90/08* (2011.01)
*F24B 5/02* (2006.01)
*F23B 30/00* (2006.01)
*F24B 1/00* (2006.01)

(52) U.S. Cl.
CPC ..... *F24B 1/006* (2013.01); *F24B 5/026* (2013.01); *F23J 2219/10* (2013.01)

(58) Field of Classification Search
CPC ..... F23B 5/021; F23B 5/023; F23B 90/08; F23B 1/02; F23B 1/00; F23B 1/08; F23B 60/00; F23B 60/02; F23B 80/04; F23G 7/07; F23J 2219/10
USPC ..... 126/76
IPC ..... F23B 90/08; F23G 7/07; F24B 1/02, 13/00
See application file for complete search history.

(56) References Cited

U.S. PATENT DOCUMENTS 4,510,918 A 4/1985 Ferguson et al.
4,646,712 A 3/1987 Ferguson et al.
4,827,852 A 5/1989 Piontkowski
4,862,869 A * 9/1989 Hazard ..... F23B 5/04 126/77
5,050,579 A * 9/1991 Melton ..... F23B 5/02 126/77
6,041,770 A 3/2000 Erickson
6,216,687 B1 4/2001 Campbell et al.
6,705,310 B2 * 3/2004 Buzzard ..... F24B 5/026 126/523
6,935,333 B2 * 8/2005 Buzzard ..... F24B 5/026 126/515
7,082,942 B2 * 8/2006 Buzzard ..... F24B 5/026 126/523
8,646,441 B2 * 2/2014 Haas ..... F24B 1/006 126/77
8,869,788 B2 * 10/2014 Brooks ..... F23N 3/007 126/77
9,046,273 B2 * 6/2015 Purinton ..... F24B 13/004
9,170,025 B2 10/2015 Atemboski et al.
9,651,262 B1 * 5/2017 Barry ..... F23C 6/045
10,041,682 B1 * 8/2018 Myers ..... F23B 80/04
10,197,286 B2 * 2/2019 Stewart ..... F23L 1/02
10,788,216 B2 * 9/2020 Purinton ..... F24B 1/006
2003/0192527 A1 * 10/2003 Buzzard ..... F24B 5/026 126/77
2004/0129266 A1 * 7/2004 Buzzard ..... F24B 13/02 126/542
2005/0183714 A1 * 8/2005 Buzzard ..... F24B 5/026 126/77
2008/0041357 A1 2/2008 Brown
2011/0008214 A1 * 1/2011 Haas ..... B01D 53/74 422/105
2011/0168153 A1 * 7/2011 Purinton ..... F24B 1/187 126/77
2011/0220090 A1 * 9/2011 Atemboski ..... F24B 1/026 126/500
2011/0247533 A1 10/2011 Haas et al.
2013/0206129 A1 * 8/2013 Brooks ..... F24B 5/026 126/77
2014/0093829 A1 * 4/2014 Johnson ..... F23J 15/02 431/170
2014/0109806 A1 * 4/2014 Atemboski ..... F24B 1/181 110/345
2014/0196637 A1 * 7/2014 Stewart ..... F23L 1/02 110/229
2014/0311477 A1 10/2014 Davenport
2015/0075510 A1 * 3/2015 Kristensen ..... F24B 1/006 126/77
2015/0253006 A1 * 9/2015 Grace ..... F23B 90/08 110/345
2018/0119959 A1 5/2018 Purinton et al.

FOREIGN PATENT DOCUMENTS

JP 2013088067 A * 5/2013
JP 2014020573 A * 2/2014
JP 2014137168 A * 7/2014
JP 2014238208 A * 12/2014 ..... F24B 1/006
WO 2011098267 A1 8/2011
WO 2018085225 5/2018

OTHER PUBLICATIONS

MF Fire Catalyst Wood Stove, 3 pages, May 21, 2016.
Blaze King Ashford 20.1, Operation and Installation Manual, Valley Comfort Systems Inc., Canada, 40 pages, Sep. 10, 2014.
Dutchwest Convection Heater, Damper Function, 3 pages, at least as early as Feb. 2012.
"How Lopi Wood Stoves Work", Travis Industries, 4 pages, as early as 2015.
Blaze King Ashford, Operating Instructions, 1 page, May 25, 2015.
Intrepid II Woodburning Stove Model 1990, Homeowner's Installation and Operating Manual, Vermont Castings, Inc., 40 pages, 1990.
Intrepid II Woodburning Stove Model 1990, Homeowner's Installation and Operating Manual, Vermont Castings, Inc., self regulating secondary air supply, pp. 1, 4, 33, and 35, 1990.
Intrepid II Wood Burning Stove—Homeowner's Installation & Operating Manual, Model 1990, Vermont Castings, Inc., 40 pages, Jul. 2013.
Defiant Encore Owner's Guide, Model #2190, available from Vermont Castings, Inc., www.vermontcastings.com, 31 pages, Apr. 1994.
Aspen Non-Catalytic Wood Stove and Intrepid II Catalytic Wood Stove Brochure, printout available on Oct. 16, 2017, at http://downloads.hearthnhome.com/brochures/VC1608_CatNonCatStoves.pdf, 5 pages, 2015.
International Search Report and Written Opinion, International Application No. PCT/US2017/059192, 12 pages, dated Jan. 24, 2018.

* cited by examiner

NON-BYPASSABLE CATALYST ASSISTED APPLIANCES

CROSS-REFERENCE TO RELATED APPLICATIONS

This application is a continuation of U.S. patent application Ser. No. 15/799,202, filed on Oct. 31, 2017, which application claims the benefit of U.S. Provisional Application No. 62/415,863, filed Nov. 1, 2016, entitled "Non-Bypassable Catalyst Assisted Appliances", and which applications is hereby incorporated herein by reference in its entirety.

FIELD OF THE DISCLOSURE

The present disclosure is directed generally to wood heaters, and more particularly to non-bypassable catalyst assisted appliances.

BACKGROUND

FIGS. 1 and 2 illustrate a prior art catalyst assisted wood stove 10 disposed in a normal operating configuration with a loading door 16 disposed in a closed position, and a catalyst bypass door 20 (FIG. 2) disposed in a closed position. Catalyst bypass door 20 (FIG. 2) is located inside the firebox at the top of the catalyst assisted wood stove. Catalyst bypass door 20 (FIG. 2) may be a steel plate or other non-combustible material, hinged inside the stove, and controlled by a catalyst bypass handle 30 (FIG. 1) on the stove. When handle 30 (FIG. 1) is disposed toward the rear of catalyst assisted wood stove 10, catalyst bypass door 20 (FIG. 2) is closed. In the closed configuration, catalyst bypass door 20 (FIG. 2) prevents smoke and combustion gas from a fire from bypassing, or going around, a catalytic combustor 40 (FIG. 2), i.e., smoke and combustion gas from the fire is made to go through catalytic combustor 40 (FIG. 2) and out a flue 50 as shown by arrow A.

FIGS. 3 and 4 illustrate prior art catalyst assisted wood stove 10 disposed in a starting or wood loading configuration with loading door 16 disposed in an open position and catalyst bypass door 20 (FIG. 4) disposed in an open bypass position. In order to prevent smoke and combustion gas from a fire from exiting an open loading door opening 17 due to the air flow restriction caused by the catalyst combustor when starting a fire or loading wood in catalyst assisted wood stove 10, a user needs to move handle 30 (FIG. 3) towards the front of catalyst assisted wood stove 10 to place catalyst bypass door 20 (FIG. 4) in an open position. In the open position, catalyst bypass door 20 (FIG. 4) allows smoke from a fire to bypass or go around catalytic combustor 40, i.e., smoke from the fire bypasses catalytic combustor 40 and instead goes out flue 50 as shown by arrow B instead of out loading door opening 17.

U.S. Pat. No. 4,827,852, issued to Piontkowski, discloses a catalytic wood stove having a catalyst bypass damper, which damper is closed during normal operation of the stove.

Vermont Castings' Intrepid II Woodburning Stove Model 1990, available since 1990, is a catalytic wood stove having a catalyst bypass damper. The catalyst wood stove includes self-regulating secondary air which employs a secondary air flap, and a secondary probe assembly having a bi-metallic coil operable in response to gas exhausted out of the catalyst. The secondary probe assembly is connected to the secondary air flap via a connecting rod.

SUMMARY

Shortcomings of the prior art are overcome and additional advantages are provided through the provision, in one embodiment, of a non-bypassable catalyst assisted appliance which includes, for example, a non-bypassable catalyst assisted appliance having a housing with a combustion chamber. A loading door opening in the housing coverable by a door for loading fuel into the combustion chamber. An air inlet opening in the housing for receiving an air supply to the combustion chamber, and an exit opening connectable to a flue. A platform defining a non-movable separation in the housing between the combustion chamber and the exit opening. An insulated catalyst combustor is disposed between a top wall of the housing and the platform. When the door of the non-bypassable catalyst assisted appliance is disposed in a closed position covering the loading door opening, gas from the combustion chamber is exhausted and directed along a single flow path horizontally through the insulated catalytic combustor and into the flue. When the door of the non-bypassable catalyst assisted appliance is disposed in an open position allowing loading of fuel through the loading door opening to the combustion chamber, gas from the combustion chamber is inhibited from passing through the loading door opening, and ambient air entering the loading door opening and combustion gas from the combustion chamber are exhausted and directed along a single flow path horizontally through the insulated catalytic combustor and into the flue.

In another embodiment, a method includes, for example, directing along the single flow path, when the door of the housing of the above-described non-bypassable catalyst assisted appliance is disposed in the closed position covering the loading door opening, gas from the combustion chamber through the insulated catalytic combustor and into the flue, inhibiting, when the door of the housing is disposed in the open position, combustion gas from passing through the loading door opening, and directing along the single flow path, when the door of the housing is disposed in the open position, ambient air entering the loading door opening and combustion gas from the combustion chamber through the insulated catalytic combustor and into the flue.

In another embodiment, a method includes, for example, directing along a first single flow path, when a door of a housing is disposed in a closed position covering a loading door opening, all the gas from a combustion chamber through an insulated catalytic combustor and into a flue, directing along a second single flow path, when the door of the housing is disposed in the open position, all the ambient air entering the loading door opening and all the gas from the combustion chamber through the insulated catalytic combustor and into the flue, and wherein the housing does not include a movable catalyst bypass.

In another embodiment, a method for fabricating a non-bypassable catalyst assisted appliance for use in producing heat includes, for example, optimizing a size and configuration of an insulated catalyst combustor disposed between a platform defining a non-movable separation between a combustion chamber and the exit opening connectable to a flue so that when the a door of the housing is disposed in a closed position covering a loading door opening, gas from the combustion chamber is directed along a single flow path through the insulated catalyst combustor and out the flue, and when the door is disposed in an open position allowing loading of fuel through the loading door opening to the combustion chamber, ambient air entering the loading door opening and gas from the combustion chamber are directed along a single flow path through the catalyst combustor and out the flue.

In another embodiment, a non-bypassable catalyst assisted appliance includes, for example a housing having a combustion chamber. A loading door opening in the housing coverable by a door for loading fuel into the combustion chamber. An air inlet opening in the housing for receiving a primary air supply and a secondary air supply to the combustion chamber, and an exit opening connectable to a flue. A platform defining a non-movable separation in the housing between the combustion chamber and the exit opening. A secondary air supply manifold is disposed below the platform and operable for directing the secondary air supply to the combustion chamber. A catalyst combustor is disposed between the housing and the platform. An automated secondary air control system for automatically regulating the amount of flow of the secondary air supply to the secondary air supply manifold is operable based on the temperature of the catalytic combustor. When the door of the non-bypassable catalyst assisted appliance is disposed in a closed position covering the loading door opening, gas from the combustion chamber is exhausted and directed along a single flow path through the catalytic combustor and into the flue. When the door of the non-bypassable catalyst assisted appliance is disposed in an open position allowing loading of fuel through the loading door opening to the combustion chamber, gas from the combustion chamber is inhibited from passing through the loading door opening, and ambient air entering the loading door opening and combustion gas from the combustion chamber are exhausted and directed along a single flow path through the catalytic combustor and into the flue.

In another embodiment, a non-bypassable catalyst assisted appliance which includes, for example, a housing having a combustion chamber therein. The housing includes a loading door opening coverable by a door for loading fuel into the combustion chamber, an air inlet opening for receiving an air supply to the combustion chamber, and an exit opening connectable to a flue. A catalyst combustor is disposed between the combustion chamber and the exit opening. When the door of the non-bypassable catalyst assisted appliance is disposed in a closed position covering the loading door opening, gas from the combustion chamber is directed through the catalyst combustor, and out the flue. When the door of the non-bypassable catalyst assisted appliance is disposed in an open position allowing loading of fuel through the loading door opening to the combustion chamber, ambient air entering the loading door opening and gas from the combustion chamber are directed through the catalyst combustor, and out the flue.

In another embodiment, a method for operating a non-bypassable catalyst assisted appliance to produce heat is provided. The method includes, for example, providing the above-described non-bypassable catalyst assisted appliance, opening a door of the non-bypassable catalyst assisted appliance, loading wood through the opening and into the combustion chamber, while the door is open, exhausting ambient air and gas from a combustion chamber through a catalyst combustor and out a flue, and closing the door of the wood filed non-bypassable appliance; and exhausting gas from the combustion chamber through the catalyst combustor and out a flue.

In another embodiment, a method for operating a non-bypassable catalyst assisted appliance to produce heat is provided. The method includes, for example, opening a door of the non-bypassable catalyst assisted appliance, loading wood through the opening and into the combustion chamber, while the door is open, exhausting ambient air and gas from a combustion chamber through a catalyst combustor and out a flue, closing the door of the non-bypassable catalyst assisted appliance, and exhausting gas from the combustion chamber through the catalyst combustor and out a flue.

In another embodiment, a method for fabricating a non-bypassable catalyst assisted appliance for use in producing heat is provided. The method includes, for example, configuring a housing having a combustion chamber therein, a loading door opening coverable by a door for loading fuel into the combustion chamber, an air inlet opening for receiving an air supply to the combustion chamber, and an exit opening connectable to a flue, and optimizing a size and configuration of a catalyst combustor disposed between the combustion chamber and the exit opening so that when the door of the non-bypassable catalyst assisted appliance is disposed in a closed position covering the loading door opening, gas from the combustion chamber is directed through the catalyst combustor, and out the flue, and when the door of the non-bypassable catalyst assisted appliance is disposed in an open position allowing loading of fuel through the loading door opening to the combustion chamber, ambient air entering the loading door opening and gas from the combustion chamber are directed through the catalyst combustor, and out the flue.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

As described in greater detail below, the present disclosure is directed to a non-bypassable catalyst assisted appliances such as non-bypassable catalyst assistant wood heaters where a catalytic combustor does not result in substantially restricted air flow and consequent need for a catalyst bypass mode and/or mechanism as is typical in prior art catalytic assisted wood stoves. As described below, by elimination of a catalyst bypass mode and/or mechanism, the non-bypassable catalyst assisted appliances of the present disclosure is passively maintained in a clean burn mode.

Figure 1:
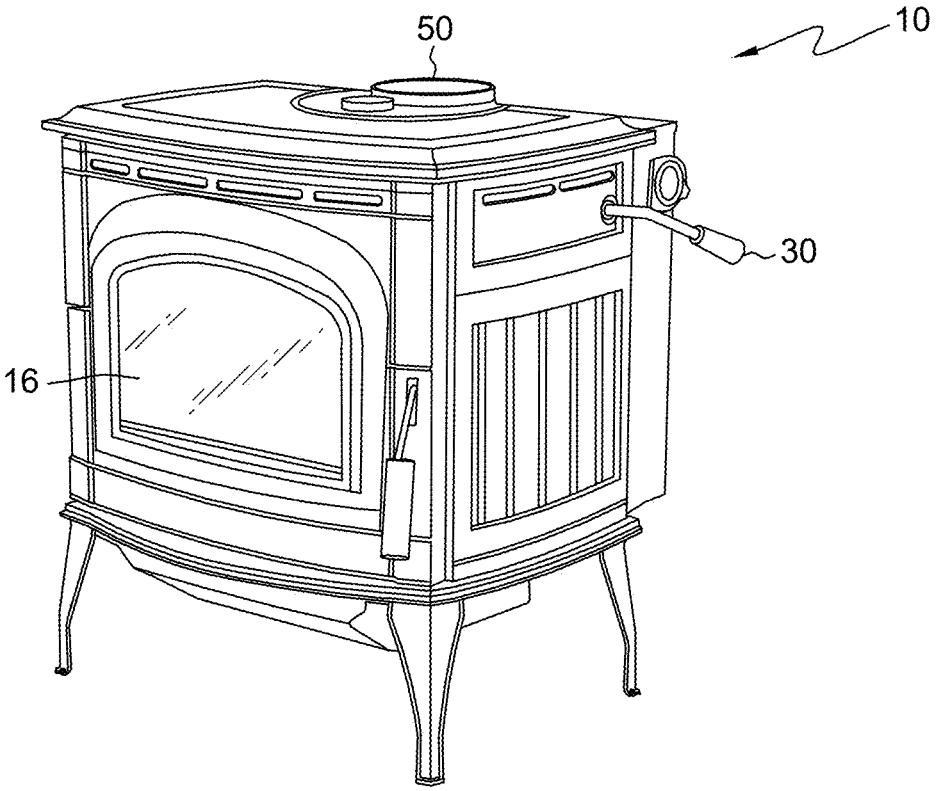
FIG. 1 (PRIOR ART)
FIG. 1 is a perspective view of a prior art catalyst assisted wood heater with a bypass mechanism disposed in a closed position.
Figure 2:
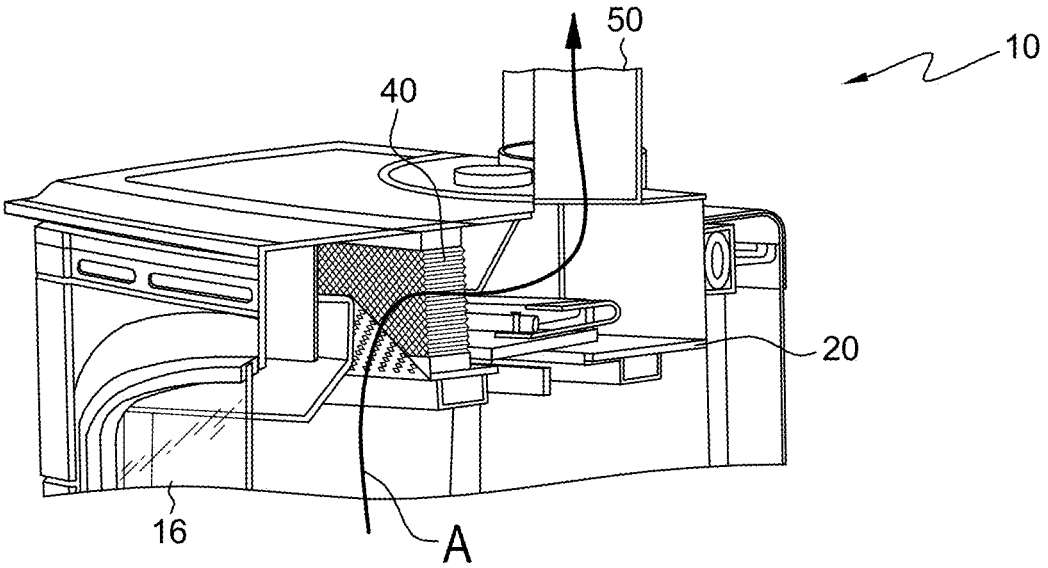
FIG. 2 (PRIOR ART)
FIG. 2 is a partial perspective view, partially cut away, of the prior art catalyst assisted wood heater of FIG. 1.
Figure 3:
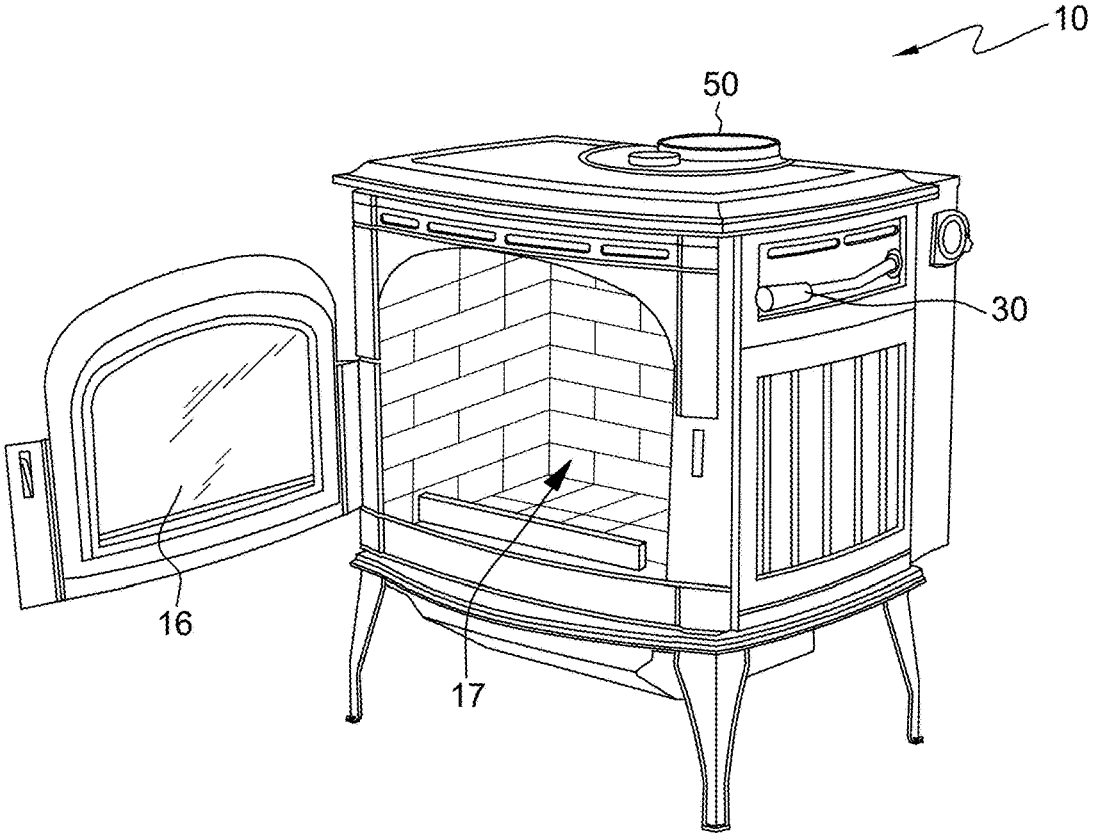
FIG. 3 (PRIOR ART)
FIG. 3 is a perspective view of the prior art catalyst assisted wood heater of FIG. 1 with the bypass mechanism disposed in an open position.
Figure 4:
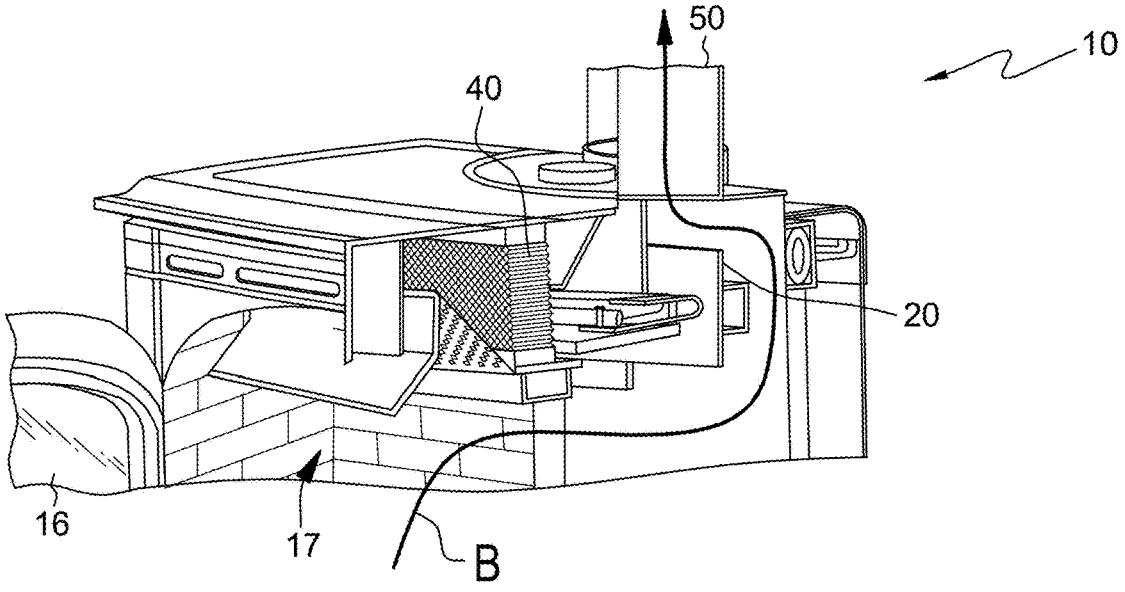
FIG. 4 (PRIOR ART)
FIG. 4 is a partial perspective view, partially cut away, of the prior art catalyst assisted wood heater of FIG. 3.
Figure 5:
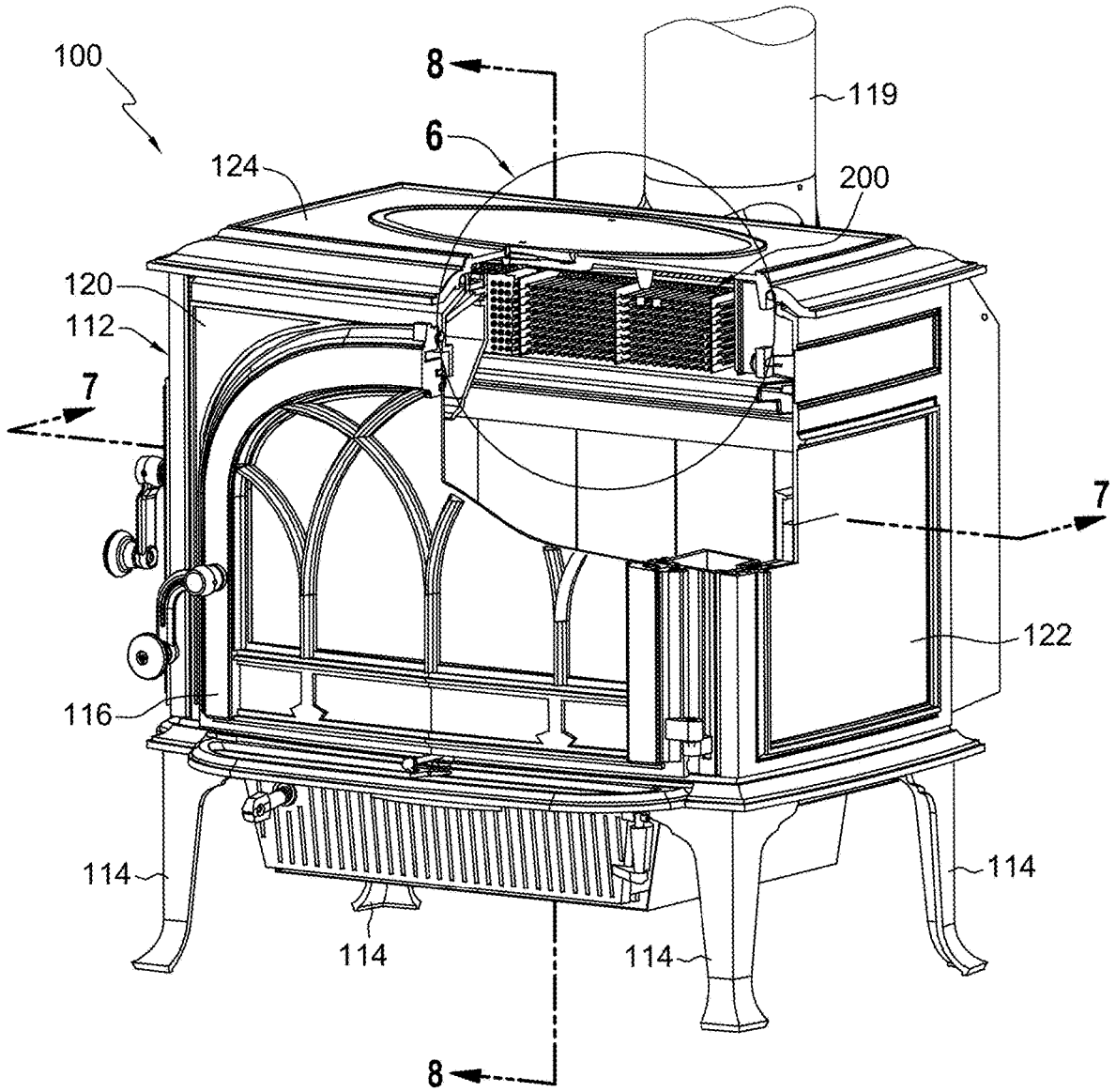
FIG. 5 is a perspective view, partially cut away, of a non-bypassable catalyst assisted appliance according to an embodiment of the present disclosure.

FIG. 5 illustrates a non-bypassable catalyst assisted appliance according to an embodiment of the present disclosure. In other embodiments, a non-bypassable catalyst assisted appliance may be configured as a wood heater or vented wood fireplace heater. For example, a non-bypassable catalyst assisted wood heater 100 may generally include a housing 112 supported by a plurality of feet 114, and a door 116. Housing 112 may include a front wall 120 having a door opening which is covered by door 116, a pair of sidewalls 122 (only one of which is shown in FIG. 5), a top wall 124, and a rear wall, and bottom wall (not shown in FIG. 5). A flue 119 in fluid communication via an exit opening 118 (FIGS. 8 and 9) with the inside of the housing may be operably connected to a chimney in a building such as a home.

Figure 6:
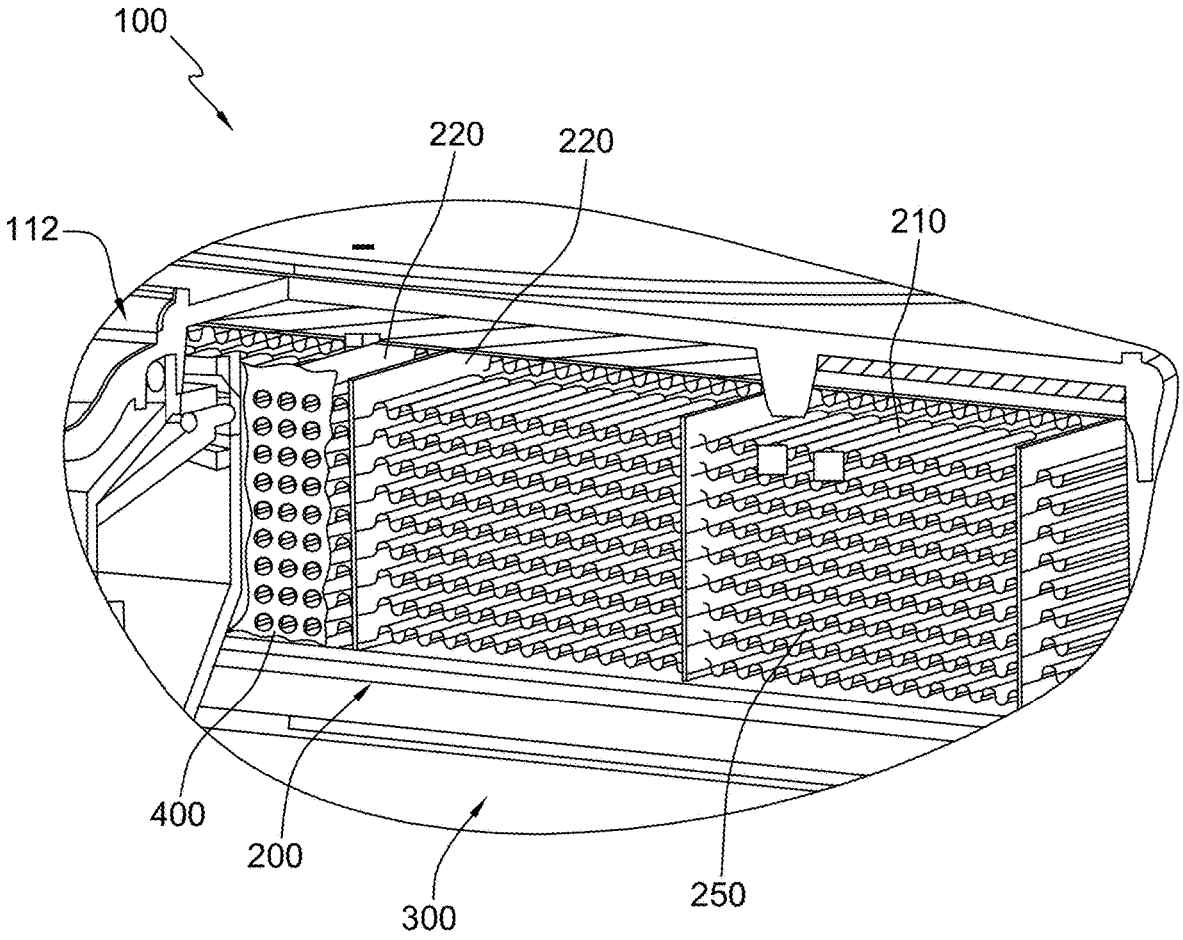
FIG. 6 is an enlarged perspective view of detail 6 of FIG. 5.
Figure 7:
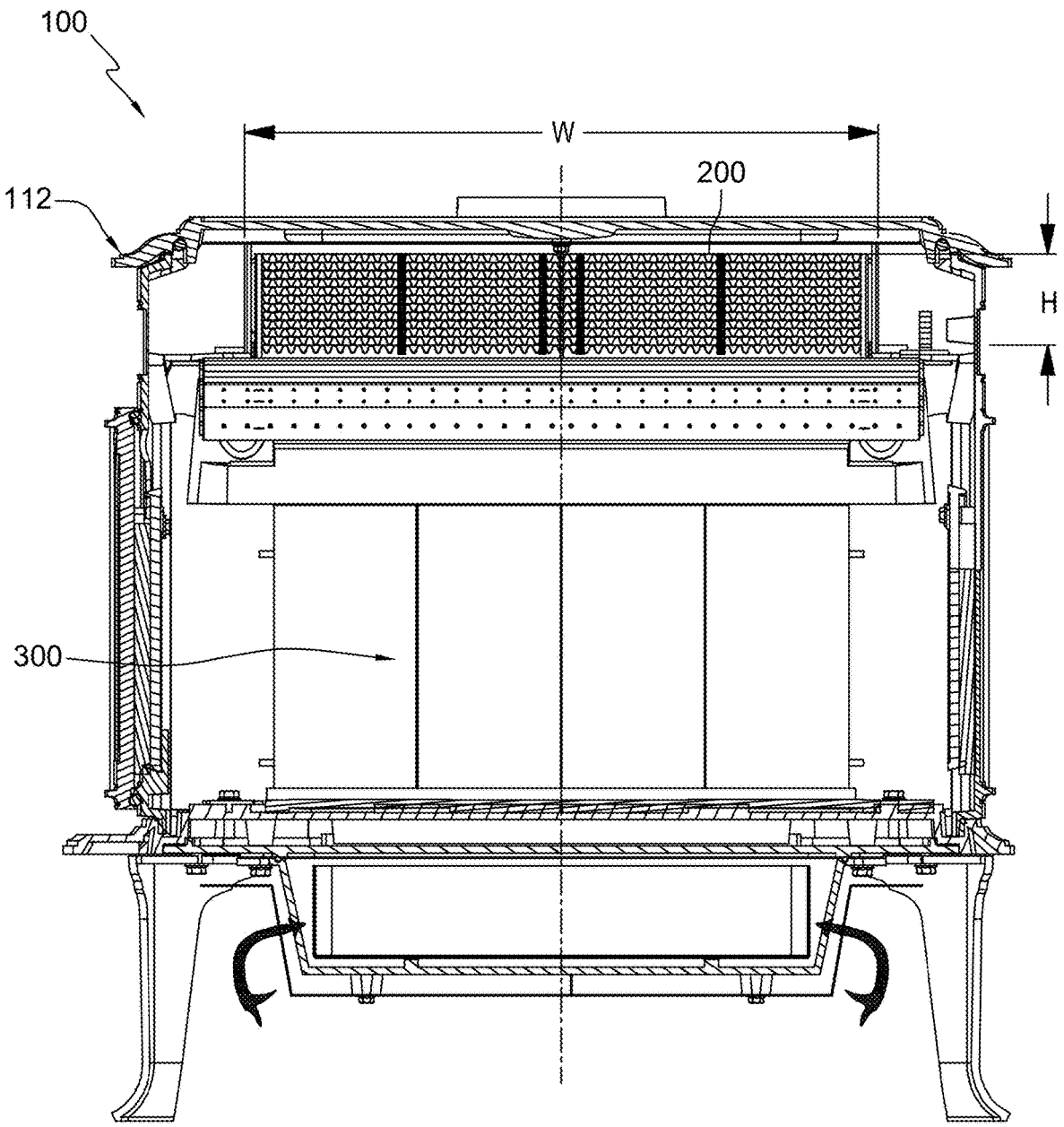
FIG. 7 is a cross-sectional view taken along line 7-7 in FIG. 1.

As shown in FIGS. 5-7, non-bypassable catalyst assisted wood heater 100 further includes a catalytic converter or catalytic combustor 200 that may extend or be disposed above a combustion chamber 300 (FIG. 7) in housing 112. For example, catalytic combustor 200 may span between the side walls of the housing and between the front wall and the rear wall of the housing. Catalytic combustor 200 may have a width W (FIG. 7), a height H (FIG. 7), and a depth D (FIG. 8).

With reference to FIG. 6, catalytic combustor 200 may have a honeycomb-like configuration. For example, catalytic combustor 200 may be formed from a plurality of spaced-apart corrugated sheets 210. A plurality of supports 220 may operably support the plurality of spaced-apart corrugated sheets 210. Adjacent upper and lower surfaces of the corrugated sheets may be spaced from each other. A diffuser or screen 400 having a plurality of apertures may be placed in front of the entrance to the combustor to act as a filter to prevent paper particles, ash, etc. from entering and physically clogging passages in the catalytic combustor. In addition, the diffuser or screen may prevent or minimize flame impingement on a catalyst combustor.

Figure 8:
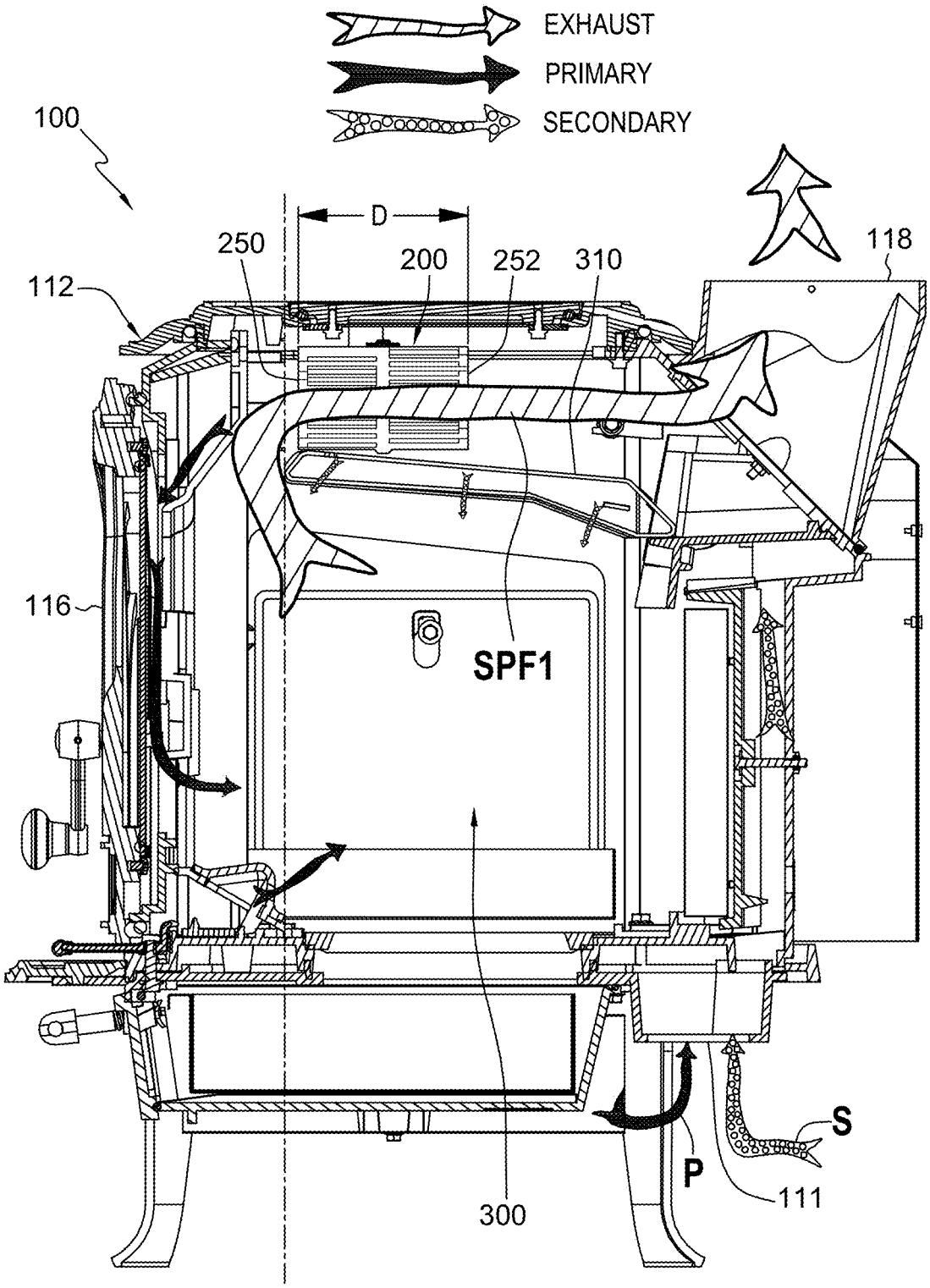
FIG. 8 is a cross-sectional view taken along line 8-8 in FIG. 1 with the loading door disposed in a closed position.

Catalytic combustor 200 may define a catalytic combustor inlet 250, and a catalytic combustor outlet 252 (FIG. 8). Catalytic combustor 200 may be supported on a platform 310 (FIG. 8) which operably forms a top surface of combustion chamber 300. For example, platform 310 may be an upper wall of an air supply manifold operable for providing a secondary supply of air S (FIG. 8) to combustion chamber 300. A primary supply of air P (FIG. 8) may also be operably provided to the combustion chamber. Primary supply of air P and secondary supply of air S (FIG. 8) may be introduced at the bottom of the housing via an air inlet opening 111. It will be appreciated that the separate or a plurality of inlet opening may be provided for primary supply of air and secondary supply of air.

Figure 10:
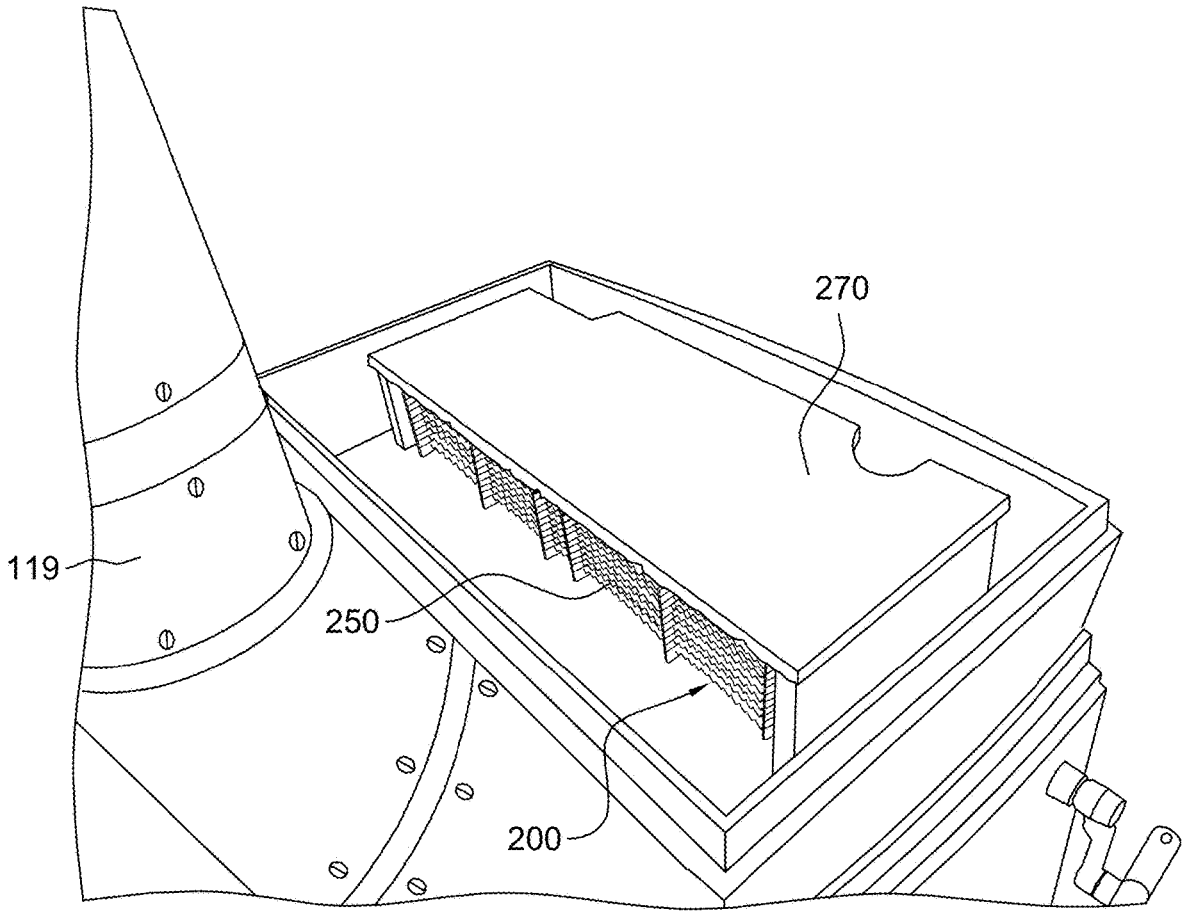
FIG. 10 is a top perspective view of the non-bypassable catalyst assisted appliance of FIG. 5 with a top removed.
Figure 11:
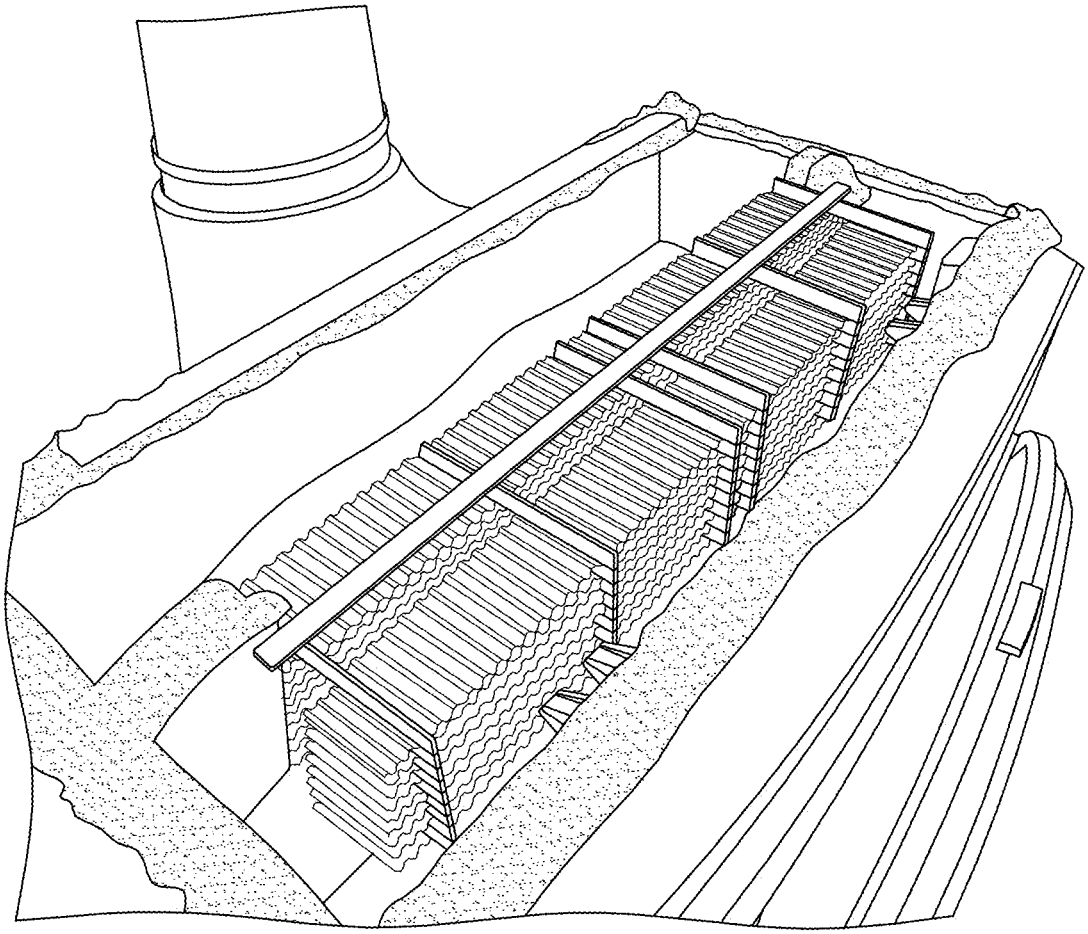
FIG. 11 is a top perspective view of the non-bypassable catalyst assisted wood heater of FIG. 5 with a top and a shroud removed.

As best shown in FIG. 10, a shroud 270 may be disposed around catalytic combustor 200 so that the exhaust of gas from combustion chamber 300 (FIG. 8) is directed to catalytic combustor inlet 250 of catalytic combustor 200, through catalytic combustor 200, and out catalytic combustor outlet 252 (FIG. 8) of catalytic combustor 200, and into flue 119. Shroud 270 may aid in keeping the catalyst combustor warm, control the flow through the catalyst combustor, and/or insulate to keep the top wall of the housing not as hot. Regarding the catalyst combustor operating temperature, the shroud or enclosure may be of sized and configured to maintain a suitable temperature environment to encourage and sustain catalyst activation.

As best shown in FIG. 8, non-bypassable catalyst assisted wood heater 100 with loading door 116 disposed in a closed position may have a single flow path SFP1 for exhausting gas from combustion chamber 300 to exit opening 118 into flue 119 (FIG. 5). For example, single flow path SFP1 of combustion gas may pass through combustor inlet 250 of catalytic combustor 200, between platform 310 and shroud 270 (FIG. 10) and through catalytic combustor 200, out catalytic combustor outlet 252 of catalytic combustor 200, and to exit opening 118 into flue 119.

Figure 9:
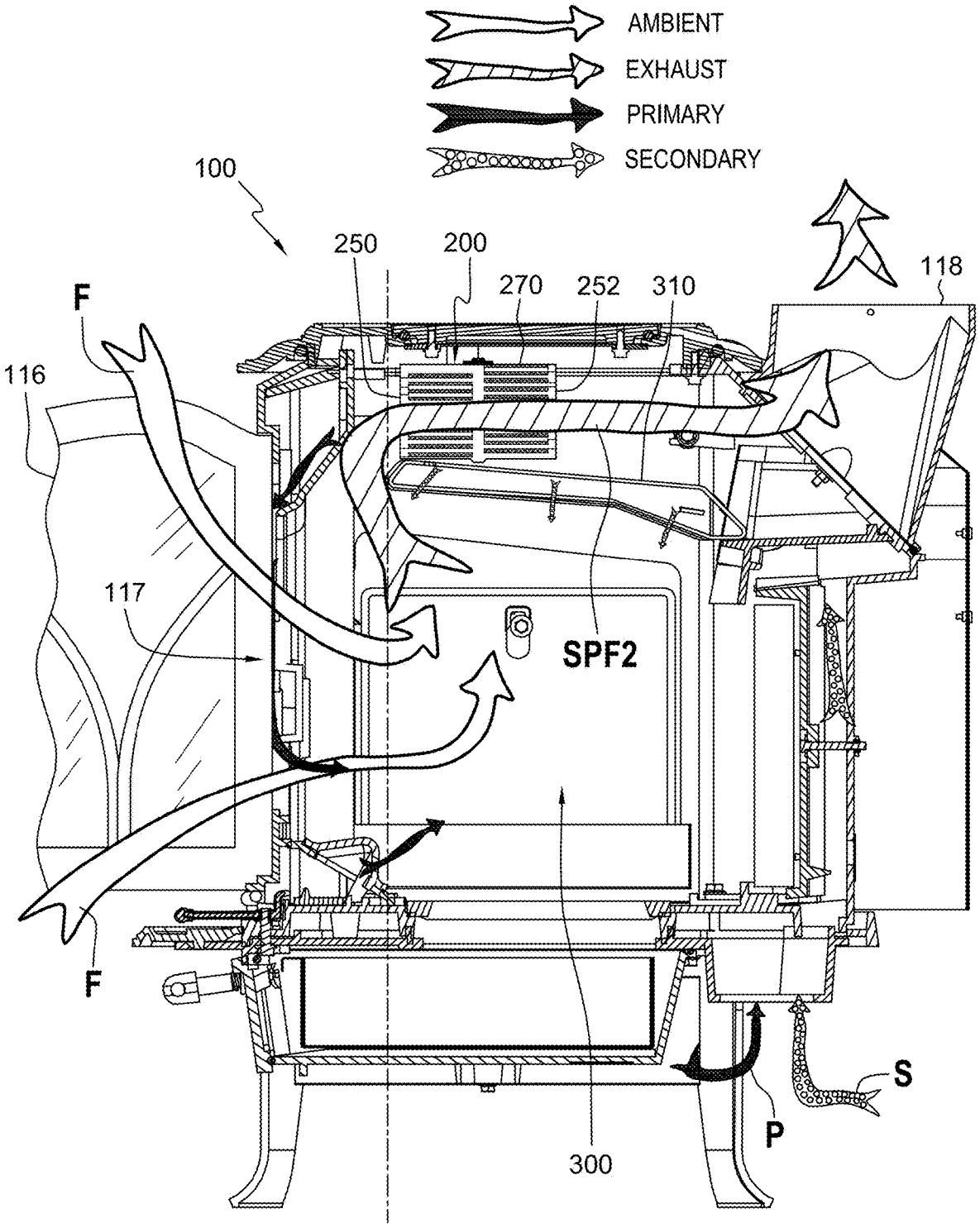
FIG. 9 is a cross-sectional view similar to FIG. 8 with the loading door disposed in an open position.

FIG. 9 illustrates non-bypassable catalyst assisted wood heater 100 with loading door 116 disposed in an open position such as when starting a fire in combustion chamber 300 or when loading fuel such as wood through door opening 117 onto an existing fire in combustion chamber 300. With loading door 116 open, a flow of ambient air F is able to pass through door opening 117 and enter combustion chamber 300. With loading door 116 open, catalyst assisted wood heater 100 may define a single flow path SFP2 for exhausting a combination of flow of ambient air F entering non-bypassable catalyst assisted heater 100 through door opening 117 and combustion gas from combustion chamber 300. For example, single flow path SFP2 of the combination of flow of ambient air and combustion gas may pass through combustor inlet 250 of catalytic combustor 200, between platform 310 and shroud 270 and through catalytic combustor 200, and out catalytic combustor outlet 252 of catalytic combustor 200, and exit opening 118 and into flue 119.

As will be appreciated, catalytic combustor 200 is sized and configured to not substantially restrict the above-described flows therethrough with loading door 116 disposed in either a closed position or in an open position compared to the restricted flow in conventional catalytic combustors in catalytic assisted wood stoves. Specifically, catalytic combustor 200 may be sized and configured to not substantially restrict the flow of combustion gas so that smoke is not undesirably exhausted out door opening 117 and into for example, a room when door 116 is opened. As will also be appreciated, the technique of the present disclosure eliminates a bypass such as a plate, damper, etc. and associated mechanisms consequently resulting in a catalytic assisted that is always passively operating in a "clean burn" mode. In contrast to conventional catalytic assisted wood stoves, the technique of the present disclosure avoids intentional or unintentional operation in a "dirty burn" mode, which can be heavily polluting.

For example, catalytic combustor 200 may be optimized and configured to have a longer travel or flow path, e.g., depth D (FIG. 8), larger inlet and outlet, e.g., height H width W (FIG. 7), and/or a larger open area or less cell density across the flow path compared to the restricted flow in conventional catalytic combustors in catalytic assisted wood stoves having a shorter depth or flow path, smaller inlet and outlet, and a more dense cell density across the flow path which restricts the flow therethrough.

FIGS. 12-16 illustrate a non-bypassable catalyst assisted appliance according to an embodiment of the present disclosure. For example, a non-bypassable catalyst assisted wood heater 1000 may be essentially the same as non-bypassable catalyst assisted wood heater 100 with the exception of the configuration of the catalytic converter or catalytic combustor, and the location of the introduction of a secondary supply of air.

For example, non-bypassable catalyst assisted wood heater 1000 may include a catalytic converter or catalytic combustor 1200 that may extend or be disposed above a combustion chamber 1300 (FIGS. 13-15) in a housing 1112. For example, catalytic combustor 200 may span between the side walls of the housing and between the front wall and the rear wall of the housing.

Figure 13:
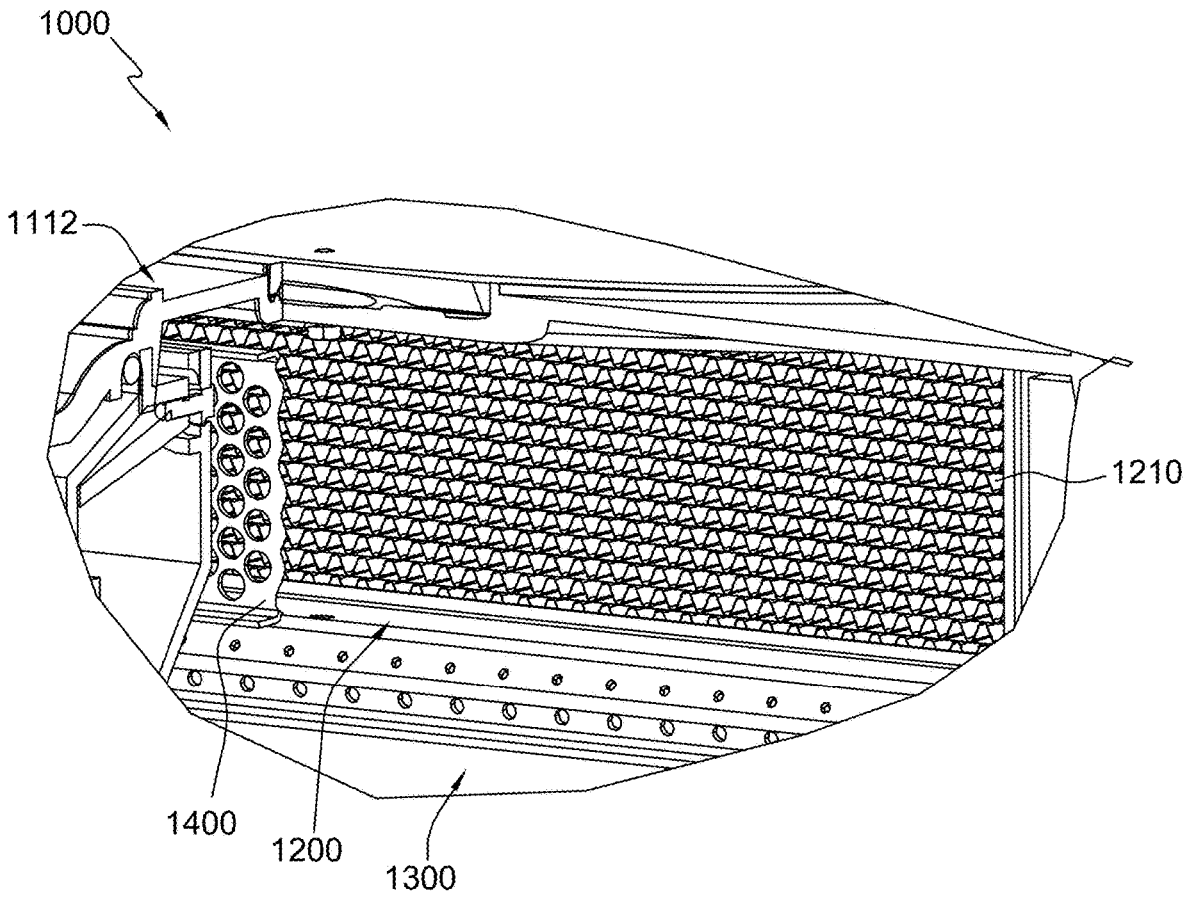
FIG. 13 is an enlarged perspective view of detail 13 of FIG. 12.
Figure 14:
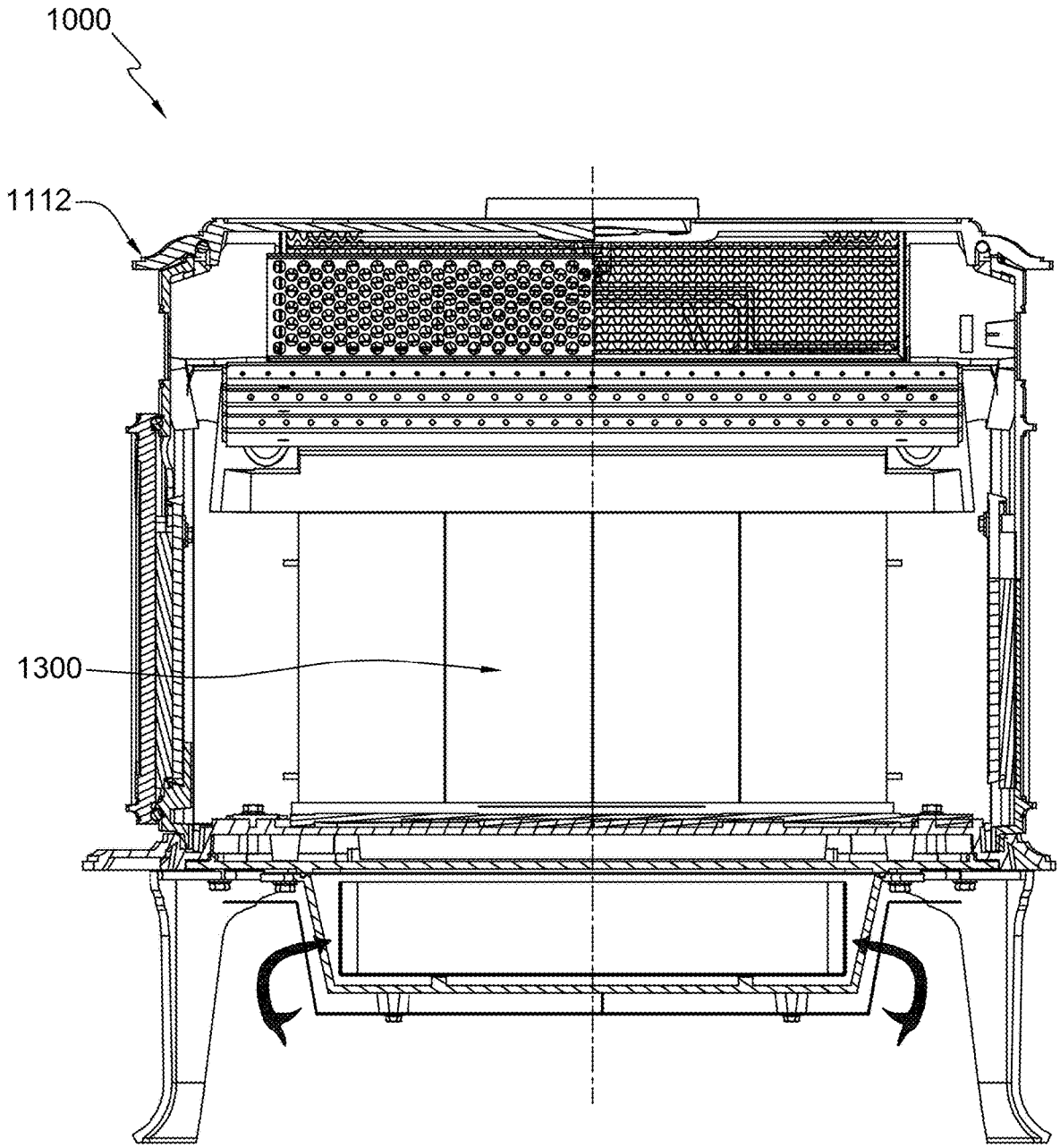
FIG. 14 is a cross-sectional view taken along line 14-14 in FIG. 1.

With reference to FIG. 13, catalytic combustor 1200 may have a honeycomb-like configuration. For example, catalytic combustor 1200 may be formed from a plurality of spaced-apart corrugated sheets 1210 operably stacked one on top of another without supporting spacers. Adjacent upper and lower surfaces of the corrugated sheets may be spaced from each other. A diffuser or screen 1400 having a plurality of apertures may be placed in front of the entrance to the combustor to act as a filter to prevent paper particles, ash, etc. from entering and physically clogging passages in the catalytic combustor. In addition, the diffuser or screen may prevent or minimize flame impingement on a catalyst combustor.

Figure 12:
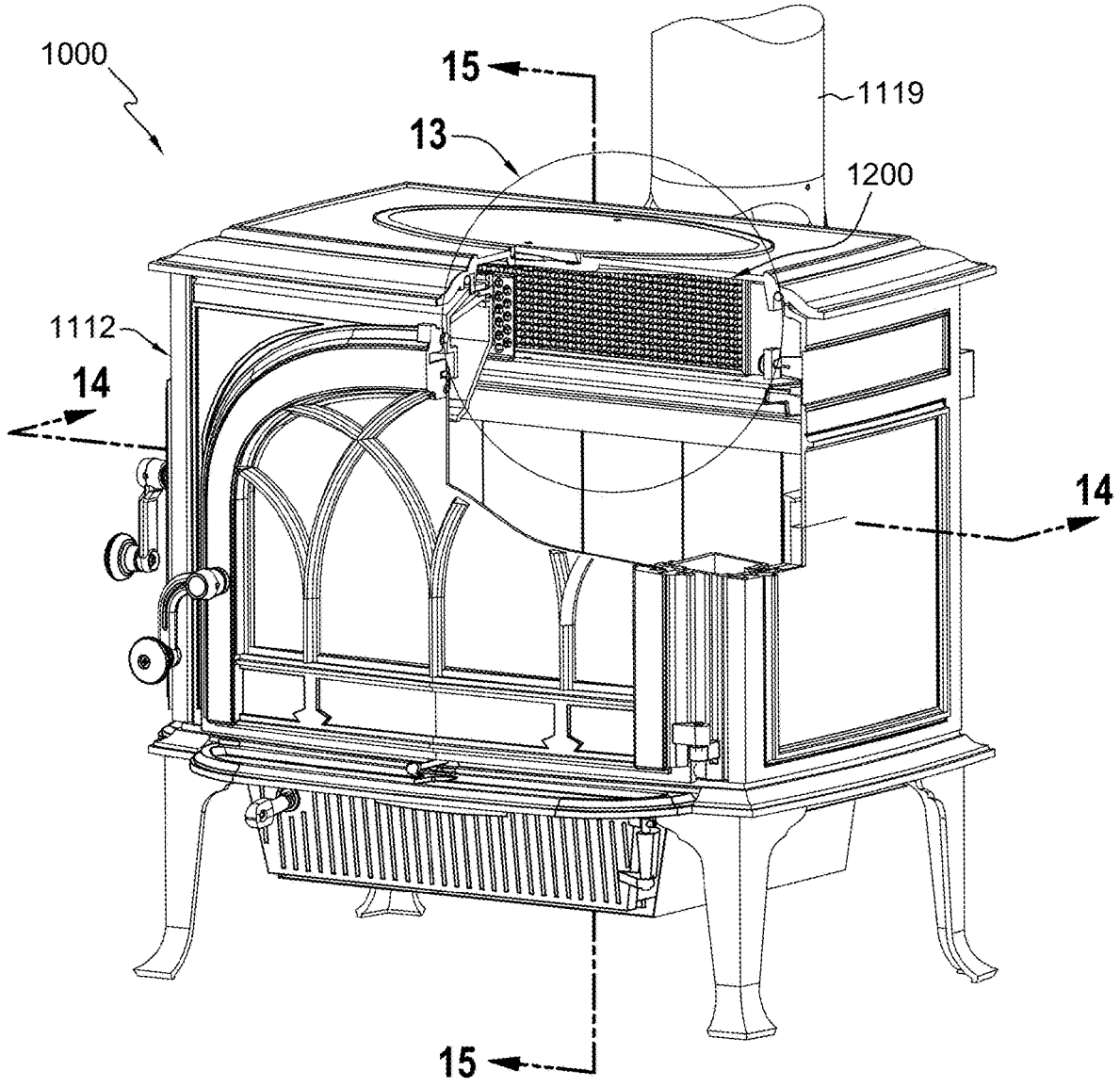
FIG. 12 is a perspective view, partially cut away, of a non-bypassable catalyst assisted appliance according to an embodiment of the present disclosure.
Figure 15:
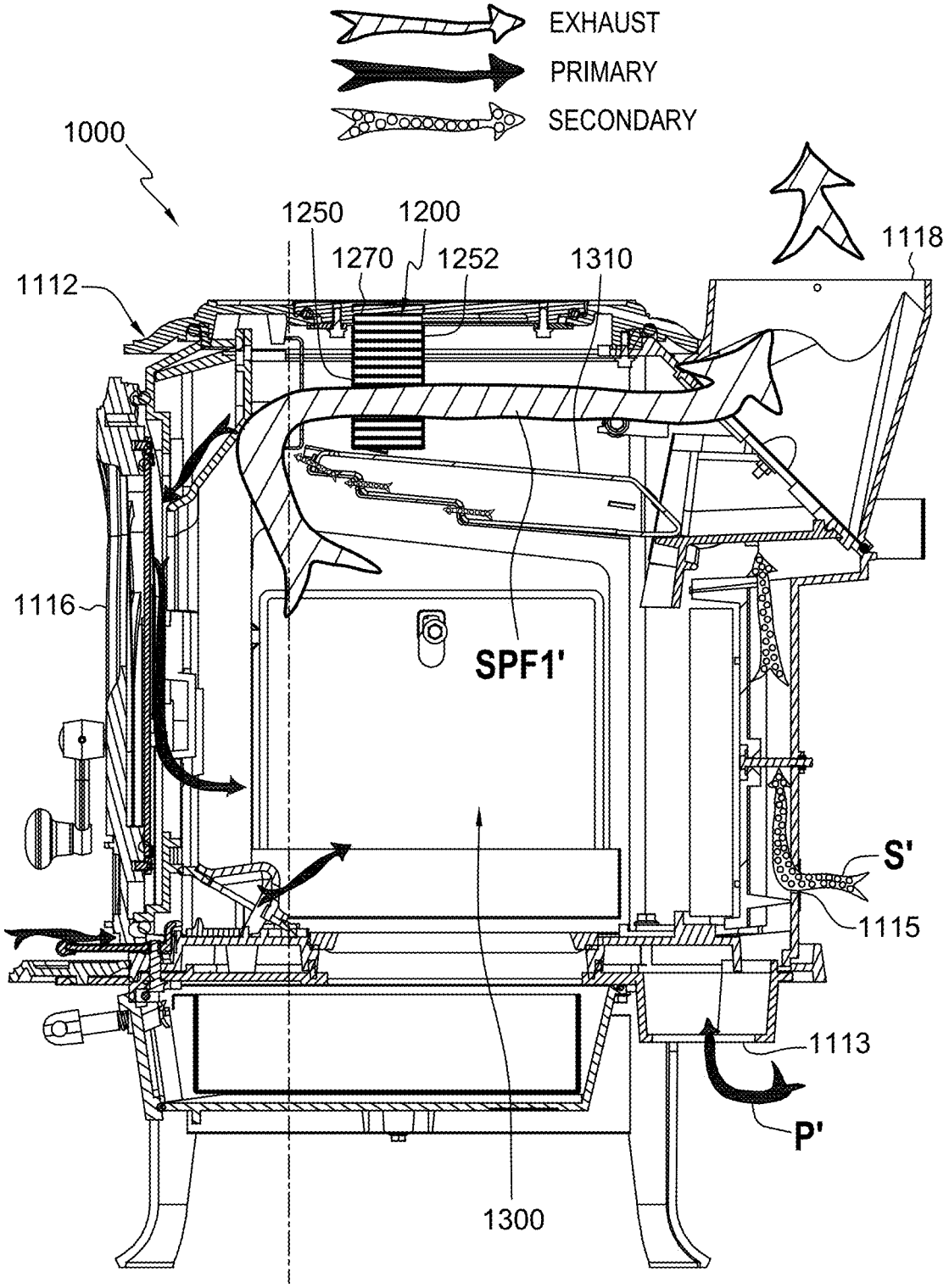
FIG. 15 is a cross-sectional view taken along line 15-15 in FIG. 1 with the loading door disposed in a closed position.

As best shown in FIG. 15, non-bypassable catalyst assisted wood heater 1100 with loading door 1116 disposed in a closed position may have a single flow path SFP1' for exhausting gas from combustion chamber 1300 to an exit opening 1118 into a flue 1119. For example, single flow path SFP1' of combustion gas may pass through combustor inlet 1250 of catalytic combustor 200, between a platform 1310 and a shroud 1270 or a top of the housing and through catalytic combustor 1200, out catalytic combustor outlet 1252 of catalytic combustor 1200, and exit opening 1118 into flue 1119 (FIG. 12).

Primary supply of air P' may be introduced at the bottom of the housing via an air inlet opening 1113. Secondary supply of air S' may be introduced at a location different from the primary supply of air P'. In this embodiment, secondary supply of air S' may be introduced via an air inlet opening 1115 at a location behind housing 1112.

Figure 16:
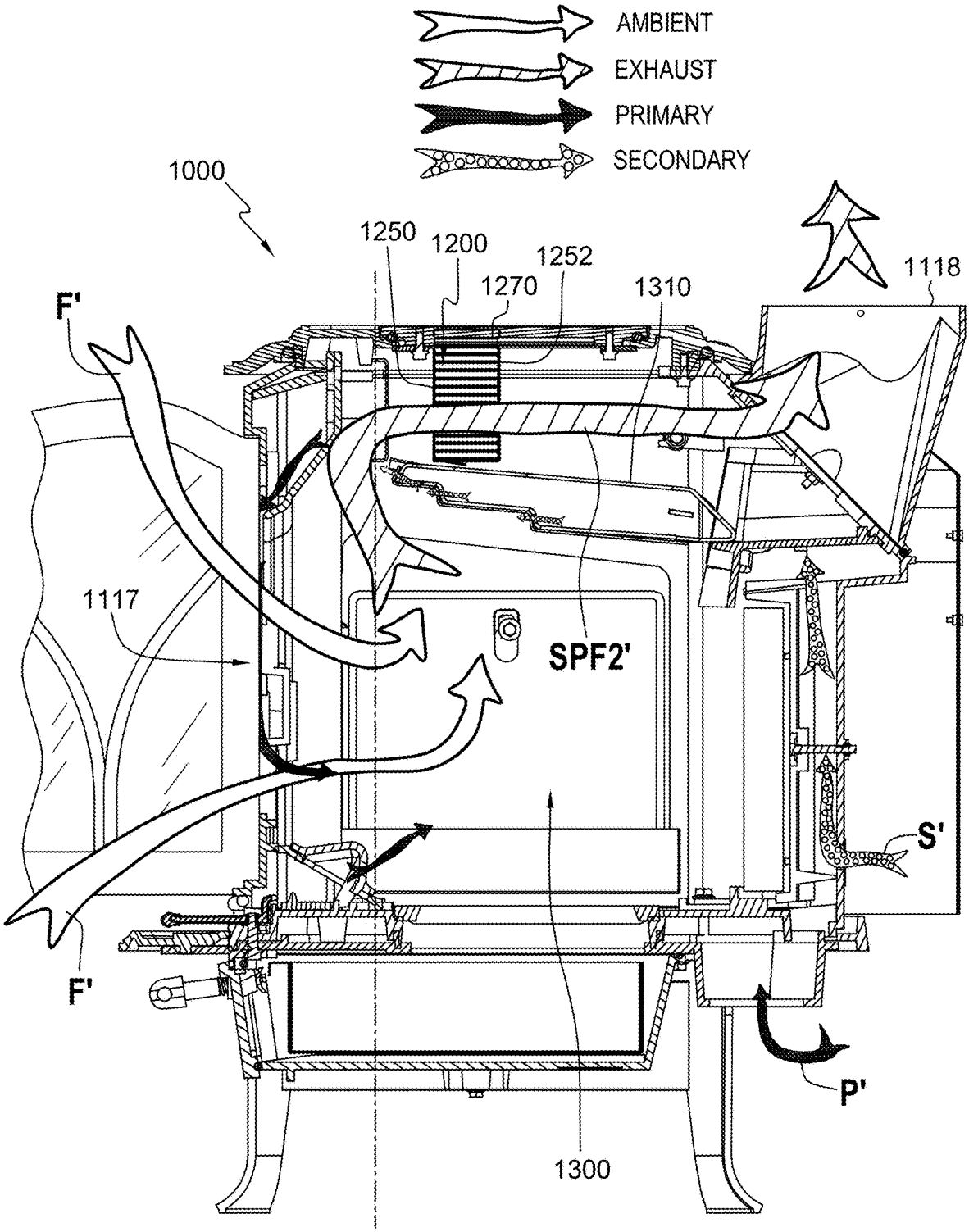
FIG. 16 is a cross-sectional view similar to FIG. 8 with the loading door disposed in an open position.

FIG. 16 illustrates non-bypassable catalyst assisted wood heater 1000 with loading door 1116 disposed in an open position such as when starting a fire in combustion chamber 1300 or when loading fuel such as wood through door opening 1117 onto an existing fire in combustion chamber 1300. With loading door 1116 open, a flow of ambient air F' is able to pass through door opening 1117 and enter combustion chamber 1300. With loading door 1116 open, catalyst assisted wood heater 1000 may define a single flow path SFP2' for exhausting a combination of flow of ambient air F' entering non-bypassable catalyst assisted heater 1000 through door opening 1117 and combustion gas from combustion chamber 1300. For example, single flow path SFP2' of the combination of flow of ambient air and combustion gas may pass through combustor inlet 1250 of catalytic combustor 1200, between platform 1310 and shroud 1270 and through catalytic combustor 1200, out catalytic combustor outlet 1252 of catalytic combustor 1200, and exit opening 1118 into flue 1119 (FIG. 12).

Figure 17:
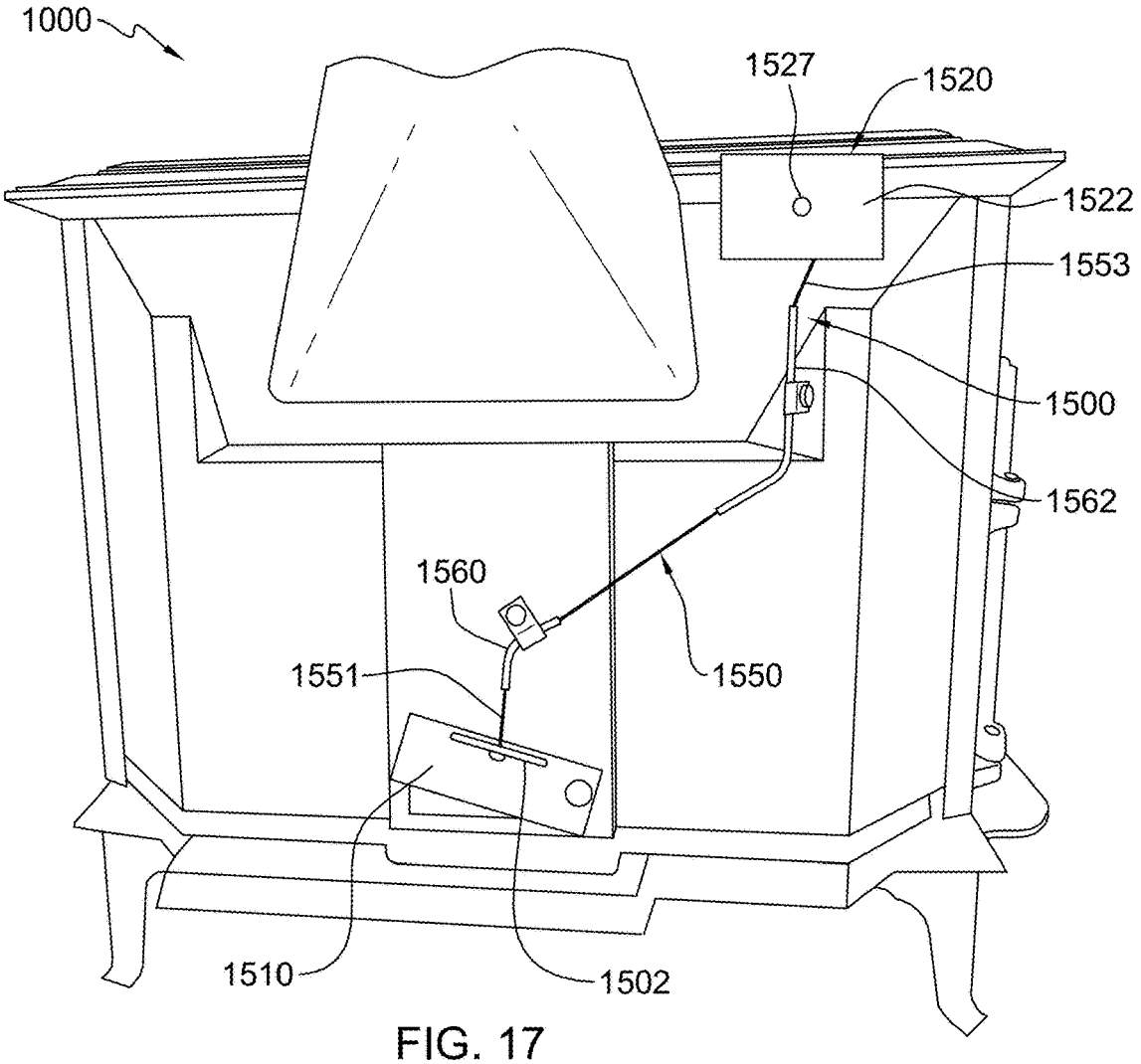
FIG. 17 is a rear elevational view of the non-bypassable catalyst assisted appliance of FIG. 8.

As shown in FIG. 17, an automated secondary air control system 1500 may be provided for regulating the amount of supply of secondary air into the non-bypassable catalyst assisted wood heater. A purpose of system 1500 may be to regulate the amount of secondary air provided to support secondary combustion. System 1500 may regulate the amount of secondary air supplied at particular stages of a burn cycle of a load of fuel in order to optimize combustion and emissions reduction performance. For example, system 1500 may provide a decreased flow of secondary air when the non-bypassable catalyst assisted wood heater is being started, or an increased flow of secondary air when the non-bypassable catalyst assisted wood heater is at an operating temperature.

System 1500 may generally include a movable secondary air cover 1510, a temperature sensing and automatic controlling unit 1520 operably connected to cover 1510 via a cable 1550.

Cover 1510 is located over secondary air opening 1115 (FIG. 15). For example, an upper edge portion of the cover may be pivotally attached via a pivot or a hinge to the rear of non-bypassable catalyst assisted wood heater 1000 to allows for opening and closing secondary air opening 1115 (FIG. 15). A lower end 1551 of cable 1550 may be operably attached to cover 1510. For example, lower end 1551 may be operably attached to a member 1502, which member extends outwardly from a rear surface of cover 1500.

Temperature sensing and automatic controlling unit 1520 may include a bi-metallic coil 1525 (best shown in FIG. 18) and a metal rod 1527 located in an enclosure 1522 at the top rear of non-bypassable catalyst assisted wood heater 1000. One end of the bi-metallic coil is attached to one end of the metal rod. The other end of the metal rod is disposed in proximity to the catalyst such as in the gas exhausted out of the catalyst. The purpose of the rod is to encourage more efficient heat transfer to the bi-metallic coil.

An end 1526 (FIG. 18) of bi-metallic coil 1525 is attached to an upper end 1553 of cable 1550. Bi-metallic coil 1525 is actuated, i.e., the coil either expands or contracts in a spiraling motion, in reaction to heat produced by or in reaction to varying temperatures in non-bypassable catalyst assisted wood heater 1000. The motion of the cable is transferred via the cable into movement of the cover. The positioning of cable 1550 may be provided by passing through tubes 1560 and 1562 operably fixedly attached to the rear of non-bypassable catalyst assisted wood heater 1000.

When non-bypassable catalyst assisted wood heater 1000 is started with a new fire, secondary air cover 1510 is disposed in a closed position. As non-bypassable catalyst assisted wood heater 1000 begins to increase in temperature, and when catalyst 1200 (FIG. 16) has been operating in proximity of about 1,000 degrees Fahrenheit (about 538 degrees Celsius), bi-metal coil 1525 (FIG. 18) will have begun reacting to the heat generated by the catalyst, and thus, begin to pull on cable 1550, which will begin to open secondary air cover 1510. Typically once non-bypassable catalyst assisted wood heater 1000 is up to a substantial operating condition the secondary air will be open to some degree dependent primarily on the burn rate. The hotter the bypassable catalyst assisted wood heater is operating and the more fuel being consumed per unit of time, the further open the secondary air cover will be disposed. It will be appreciated that other forms of automated control and/or opening/closing of the secondary air flow may be suitably provided. For example, a sliding cover may be provided.

As will be appreciated, catalytic combustor 1200 is sized and configured to not substantially restrict the above-described flows therethrough with loading door 1116 (FIG. 15) disposed in either a closed position or in an open position compared to the restricted flow in conventional catalytic combustors in catalytic assisted wood stoves. Specifically, catalytic combustor 1200 may be sized and configured to not substantially restrict the flow of combustion gas so that smoke is not undesirably exhausted out the door opening and into for example, a room when the loading door is opened. As will also be appreciated, the technique of the present disclosure eliminates a bypass such as a plate, damper, etc. and associated mechanisms consequently resulting in a catalytic assisted that is always passively operating in a "clean burn" mode. In contrast to conventional catalytic assisted wood stoves, the technique of the present disclosure avoids intentional or unintentional operation in a "dirty burn" mode, which can be heavily polluting.

In other embodiments, a non-bypassable catalyst assisted appliance according to the present disclosure may include an optimized catalytic combustor sized and configured such as the number and spacing of layer forming the catalyst combustor based on various variables, such as the size and configuration of a housing, size and configuration of a combustion chamber, and/or a size, configuration, and/or location of a loading door opening, etc. For example, a primary factor of in determining a size and configuration of a catalyst combustor may be the size of the loading door/opening combined with the natural fluid flow within a housing or firebox and its associated geometry. The general design of a catalyst combustor may remain consistent with the variable being an overall cross-sectional area that the catalyst occupies dependent on the aforementioned variables of flow and door opening. For example, a smaller loading door/opening may allow for a smaller catalytic combustor.

As an example, a non-bypassable catalyst assisted appliance may include a catalytic combustor according to the present disclosure having a width of about 15 inches to about 25 inches, a height of about 3 inches to about 5 inches, and a depth of about 4 inches to about 6 inches. In other embodiments, a non-bypassable catalyst assisted appliance may include a catalytic combustor according to the present disclosure having a width of about 20 inches, a height of about 4 inches, and a depth of about 5 inches.

The catalyst combustor may be formed from a catalyst made from Fecralloy, a high temperature very thin walled metal catalyst substrate with gama alumina that is configured to provide for minimum air flow resistance. In other embodiments, a catalyst combustor may be formed from nickel chromium cobalt molybdenum alloy such as an INCONEL alloy coated with the catalyst. In other embodiments, a catalytic combustor may be any catalytic combustor such as a one-piece cellular ceramic honeycomb unit. The various structures of the catalyst combustors may be coated with a noble metal catalyst such as a platinum metal.

In some embodiments, a sieve or mixing screen or similar device prior to the catalyst may be employed to slow down the gas stream flow and increase residence time for combustion. A sieve or mixing screen may be interlocked with the door versus manual actuation.

It will be appreciated that the present disclosure for non-bypassable catalyst assisted appliance such as a wood heater provides for taking advantage of both the aspects of non-catalytic technology and catalytic technology. In such a non-bypassable catalyst assisted appliance, the appliance may transition between being more reliant on one or the other technologies depending on what stage of the burn cycle it is in. For example, when a new load of fuel is added to the firebox it is like adding an ice cube. The whole appliance cools down and then tries to recover thermal momentum. During this period, there really is no need for much secondary air as the CO in the exhaust is too cool to ignite, as is relied upon in typical secondary baffle non-catalytic technology. However, what happens in the new technology is that the catalyst will work under those conditions to improve and clean up the exhaust as it is not reliant on the high temperature and CO reaction with secondary air. So, the catalyst is doing the work in the early part of the burn cycle to reduce emissions. Once the stove recovers thermal momentum, the secondary baffle components increases in secondary combustion activity and assumes a large proportion of the clean burn emissions reduction. The automated secondary air control may allow for optimizing when and how much secondary air is required. It will also be appreciated that in non-bypassable catalyst assisted appliance 100 (FIG. 5, and in other stoves such as some smaller stoves, the secondary air might possibly be a fixed amount.

FIG. 17 illustrates a method 2000 for operating a non-bypassable catalyst assisted appliance to produce heat. Method 2000 includes, for example, at 2100 opening a door of the non-bypassable catalyst assisted appliance, and at 2200 loading wood through the opening and into the combustion chamber. At 2300 while the door is open, ambient air and gas is exhausted from a combustion chamber through a catalyst and out a flue. At 2400, the door of the non-bypassable catalyst assisted appliance is closed, and at 2500 gas is exhausted from the combustion chamber through the catalyst and out a flue. The method may include the non-bypassable catalyst assisted appliance not including a catalyst bypass. The method may include providing a sufficient draft through the catalyst combustor so that combustion gas is inhibited from passing through the door opening when the door is open. The method may include, when loading fuel through the loading door opening, gas from the combustion chamber is prevented from exiting the loading door opening.

Figure 18:
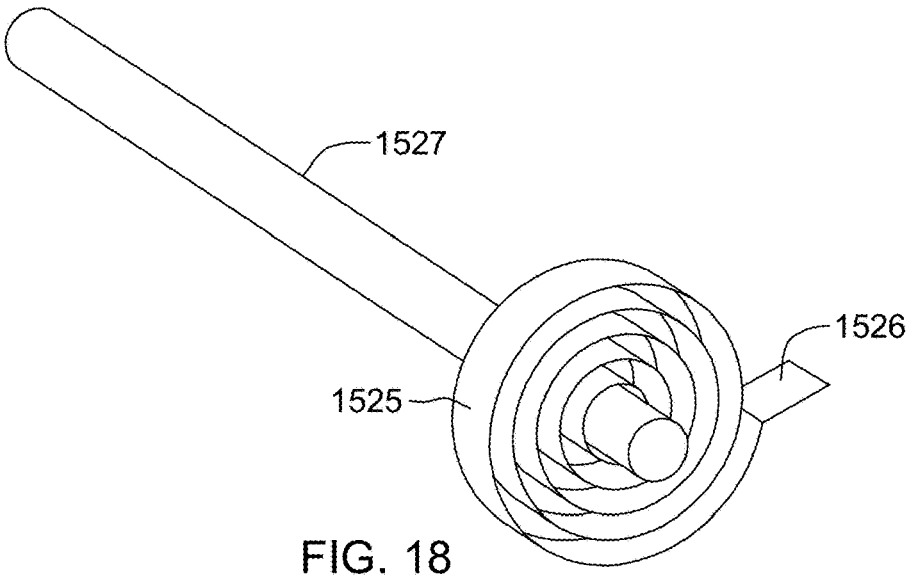
FIG. 18 is a perspective view of the bimetallic coil disposable in the temperature sensing and automatic controlling unit of the non-bypassable catalyst assisted appliance of FIG. 8.
Figure 19:
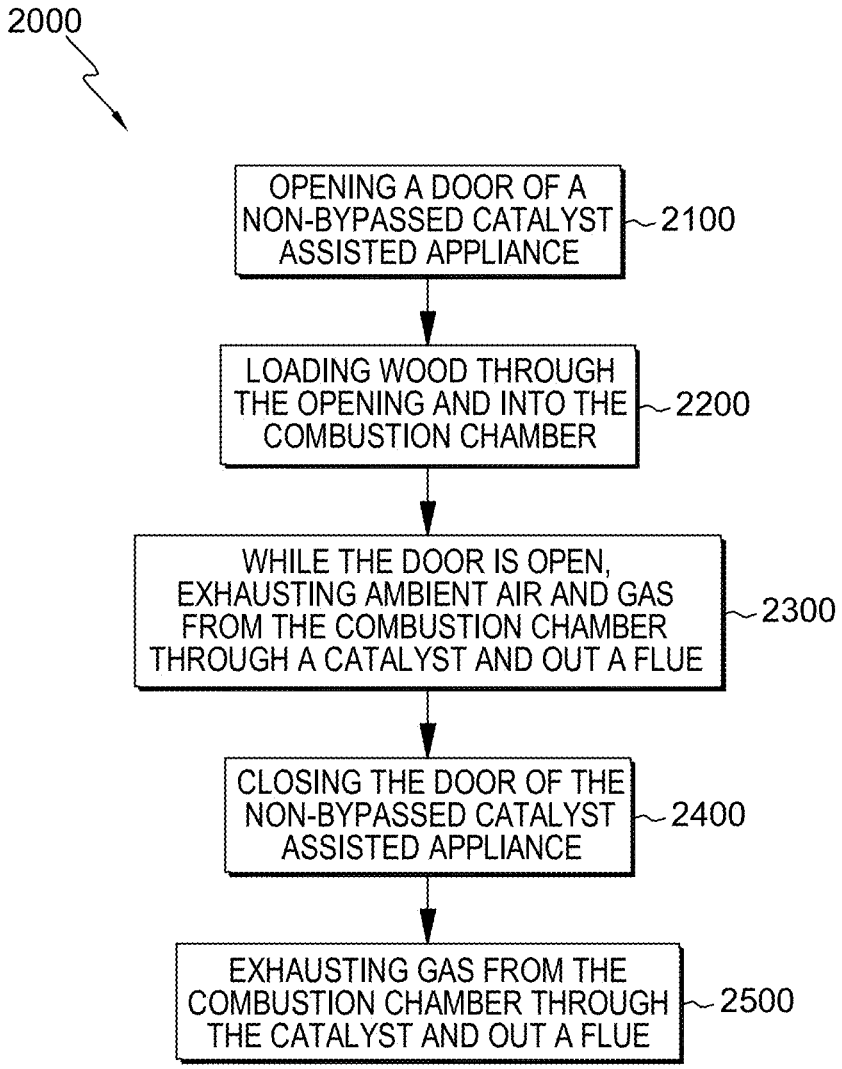
FIG. 19 is a method for operating non-bypassable catalyst assisted appliance according to an embodiment of the present disclosure.
Figure 20:
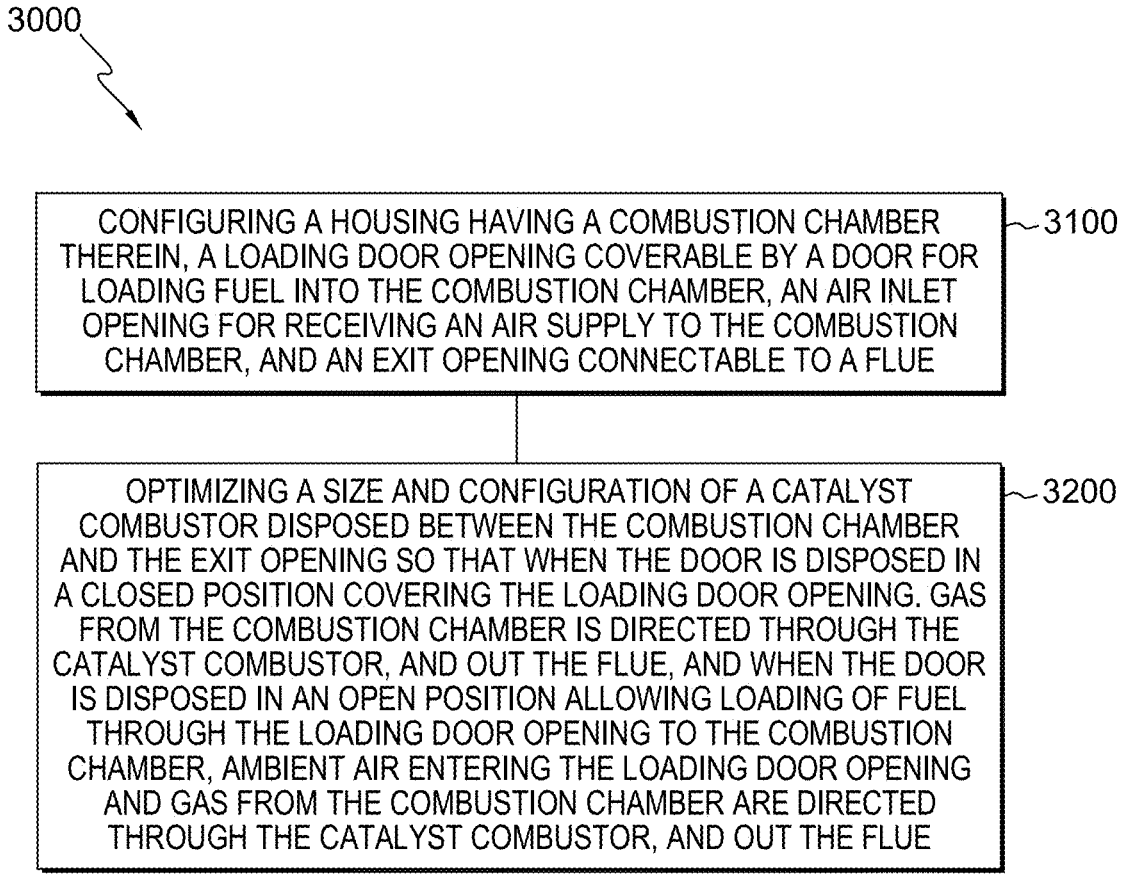
FIG. 20 is a method for fabricating a non-bypassable catalyst assisted appliance for use in producing heat according to an embodiment of the present disclosure.

FIG. 18 illustrates a method 3000 for fabricating a non-bypassable catalyst assisted appliance for use in producing heat. Method 3000 includes, for example, at 3100 configuring a housing having a combustion chamber therein, a loading door opening coverable by a door for loading fuel into the combustion chamber, an air inlet opening for receiving an air supply to the combustion chamber, and an exit opening connectable to a flue, and at 3200 optimizing a size and configuration of a catalyst combustor disposed between the combustion chamber and the exit opening so that when the door is disposed in a closed position covering the loading door opening, gas from the combustion chamber is directed through the catalyst combustor, and out the flue, and when the door is disposed in an open position allowing loading of fuel through the loading door opening to the combustion chamber, ambient air entering the loading door opening and gas from the combustion chamber are directed through the catalyst combustor, and out the flue. The method may include the non-bypassable catalyst assisted appliance not including a catalyst bypass. The method may include the optimizing including optimizing a size and configuration of a catalyst combustor based on the size of the door.

A benefit of the present disclosure is non-bypassable catalytic assisted appliances that do not require and eliminate a catalyst bypass mode or damper to overcome pressure drop across the catalyst combustor so that the catalyst assisted appliances of the present disclosure is passively maintained in a clean burn mode at all time. Such a configuration reduces the possibility of a user intentionally, or unintentionally or inadvertently operating the catalytic assisted appliance in an unclean mode, which can result in increased particulate and gaseous emissions.

Another benefit of the present disclosure is non-bypassable catalytic assisted appliances that have a higher velocity of flow through the catalyst combustor compared to conventional catalyst combustors. Such increases flow rate may result in inhibiting the accumulation of particulate on the catalyst combustor resulting is less of a need or extending the time in which to clean the catalyst combustor.

Another benefit of the present disclosure is non-bypassable catalytic assisted appliances that allows certification in a non-bypass mode. With catalytic assisted appliance having a bypass, it is necessity to operate with the bypass open during safety certification testing. Bypass open operation typically results in larger clearances to combustibles. Elimination of a bypass mode and associated test requirement may result in more market favorable clearances to combustibles.

Another benefit of the present disclosure is non-bypassable catalytic assisted appliances that may be able to reduce particulate emissions so as to be in compliance with EPA year 2020 pending regulations.

Another benefits of the present disclosure include non-bypassable catalytic assisted appliances that may be passively engaged at all times and that provides no open bypass dirty burn mode as is typical with current catalyst designs. The no bypass configuration may be beneficial to achieving desirable rear clearances, lower flow resistance may reduce potential for back puffing, less difficulty in obtaining a robust fire started, and/or less issues with ash plugging.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of one or more aspects of the disclosure and the practical application, and to enable others of ordinary skill in the art to understand one or more aspects of the disclosure for various embodiments with various modifications as are suited to the particular use contemplated.

The invention claimed is:

1. A non-bypassable catalyst assisted appliance comprising:

a housing having a combustion chamber;

a loading door opening in said housing coverable by a door for loading fuel into said combustion chamber;

an air inlet opening in said housing for receiving an air supply to said combustion chamber, and an exit opening connectable to a flue;

a platform defining a non-movable separation in said housing between said combustion chamber and said exit opening;

an insulated catalyst combustor disposed in the housing between a top wall of said housing and said platform;

wherein when said door of said non-bypassable catalyst assisted appliance is disposed in a closed position covering said loading door opening, gas from said combustion chamber is exhausted and directed along a single flow path horizontally through said insulated catalyst combustor and into the flue; and wherein when said door of said non-bypassable catalyst assisted appliance is disposed in an open position allowing loading of fuel through said loading door opening to said combustion chamber, gas from said combustion chamber is inhibited from passing through said loading door opening, and ambient air entering said loading door opening and combustion gas from said combustion chamber are exhausted and directed along a single flow path horizontally through said insulated catalyst combustor and into the flue.

2. The non-bypassable catalyst assisted appliance of claim 1 wherein said insulated catalyst combustor comprises a shroud disposed in the housing.

3. The non-bypassable catalyst assisted appliance of claim 2 wherein a top portion of said shroud is spaced from a bottom portion of said top wall.

4. The non-bypassable catalyst assisted appliance of claim 2 wherein said shroud extends along said insulated catalyst combustor from an inlet opening to an outlet opening.

5. The non-bypassable catalyst assisted appliance of claim 2 said shroud extends across an entire top portion of said insulated catalyst combustor.

6. The non-bypassable catalyst assisted appliance of claim 1 wherein said insulated catalyst combustor is disposed between side walls of said housing, and said insulated catalyst combustor comprises a catalytic combustor inlet facing a front wall of said housing and a catalytic combustor outlet facing said exit opening.

7. The non-bypassable catalyst assisted appliance of claim 6 wherein said catalytic combustor inlet comprises a vertically-disposed catalytic combustor inlet and said catalytic combustor outlet comprises a vertically-disposed catalytic combustor outlet.

8. The non-bypassable catalyst assisted appliance of claim 1 wherein a catalytic combustor inlet of said insulated catalyst combustor is disposed adjacent to a front portion of said platform.

9. The non-bypassable catalyst assisted appliance of claim 1 wherein said platform is spaced below said top wall of said housing and extends from a rear wall and side walls, and is spaced from a front wall of said housing.

10. The non-bypassable catalyst assisted appliance of claim 1 further comprising a secondary air supply manifold disposed below said platform and operable for directing a secondary air supply to said combustion chamber.

11. The non-bypassable catalyst assisted appliance of claim 10 wherein said air inlet opening comprises a plurality of air inlet openings for receiving a primary air supply and the secondary air supply.

12. The non-bypassable catalyst assisted appliance of claim 10 further comprising an automated secondary air control system for automatically regulating the amount of flow of the secondary air supply to said secondary air supply manifold.

13. The non-bypassable catalyst assisted appliance of claim 12 wherein said automated secondary air control system comprises a bimetallic element.

14. The non-bypassable catalyst assisted appliance of claim 1 wherein said insulated catalyst combustor comprises a width of about 20 inches and a height of about 4 inches.

15. The non-bypassable catalyst assisted appliance of claim 1 wherein said housing comprises a window.

16. The non-bypassable catalyst assisted appliance of claim 1 wherein said combustion chamber comprises a wood burning combustion chamber.

17. A method comprising:

directing along the single flow path, when the door of the housing of the non-bypassable catalyst assisted appliance of claim 1 is disposed in the closed position covering the loading door opening, gas from the combustion chamber through the insulated catalyst combustor and into the flue;

inhibiting, when the door of the housing is disposed in the open position, gas from the combustion chamber from passing through the loading door opening; and directing along the single flow path, when the door of the housing is disposed in the open position, ambient air entering the loading door opening and gas from the combustion chamber through the insulated catalyst combustor and into the flue.

18. The method of claim 17 further comprising automatically regulating an amount of flow of a secondary air supply to the combustion chamber.

19. The method of claim 17 further comprising loading fuel through the loading door opening and into the combustion chamber.

20. A method for fabricating a non-bypassable catalyst assisted appliance for use in producing heat, the method comprising:

providing the non-bypassable catalyst assisted appliance of claim 1; and optimizing a size and configuration of an insulated catalyst combustor disposed in the housing and above a platform defining a non-movable separation between a combustion chamber and the exit opening connectable to a flue so that when a door of the housing is disposed in a closed position covering a loading door opening, gas from the combustion chamber is directed along a single flow path through the insulated catalyst combustor and out the flue, and when the door is disposed in an open position allowing loading of fuel through the loading door opening to the combustion chamber, ambient air entering the loading door opening and gas from the combustion chamber are directed along a single flow path through the insulated catalyst combustor and out the flue.

21. The method of claim 20 wherein the optimizing comprises optimizing a size and configuration of a catalyst combustor based on the size of the door.

22. A method comprising:

directing along a first single flow path, when a door of a housing is disposed in a closed position covering a loading door opening, all the gas from a combustion chamber through an insulated catalyst combustor in the housing and into a flue;

directing along a second single flow path, when the door of the housing is disposed in the open position, all of the ambient air entering the loading door opening and all of the gas from the combustion chamber through the insulated catalyst combustor and into the flue; and wherein the housing does not include a movable catalyst bypass.

23. The method of claim 22 wherein the first single flow path extends horizontally through the insulated catalyst combustor, and the second flow path extends horizontally through the insulated catalyst combustor.

24. The method of claim 22 wherein the insulated catalyst combustor comprises a shroud disposed in the housing.

25. The method of claim 22 further comprising automatically regulating an amount of flow of a secondary air supply to the combustion chamber.

26. The method of claim 22 further comprising loading fuel through the loading door opening and into the combustion chamber.

27. A non-bypassable catalyst assisted appliance comprising:

a housing having a combustion chamber;

a loading door opening in said housing coverable by a door for loading fuel into said combustion chamber;

an air inlet opening in said housing for receiving a primary air supply and a secondary air supply to said combustion chamber, and an exit opening connectable to a flue;

a platform defining a non-movable separation in said housing between said combustion chamber and said exit opening;

a secondary air supply manifold disposed below said platform and operable for directing the secondary air supply to said combustion chamber;

an insulated catalyst combustor disposed in the housing between said housing and said platform;

an automated secondary air control system for automatically regulating the amount of flow of the secondary air supply to said secondary air supply manifold operable based on the temperature of said insulated catalyst combustor;

wherein when said door of said non-bypassable catalyst assisted appliance is disposed in a closed position covering said loading door opening, gas from said combustion chamber is exhausted and directed along a single flow path through said insulated catalyst combustor and into the flue; and wherein when said door of said non-bypassable catalyst assisted appliance is disposed in an open position allowing loading of fuel through said loading door opening to said combustion chamber, gas from said combustion chamber is inhibited from passing through said loading door opening, and ambient air entering said loading door opening and gas from said combustion chamber are exhausted and directed along a single flow path through said insulated catalyst combustor and into the flue.

28. The non-bypassable catalyst assisted appliance of claim 27 wherein the gas from said combustion chamber is exhausted and directed horizontally along the single flow path through said insulated catalyst combustor and into the flue, and wherein the ambient air entering said loading door opening and gas from said combustion chamber are exhausted and directed horizontally along the single flow path through said insulated catalyst combustor and into the flue.

29. The non-bypassable catalyst assisted appliance of claim 27 further comprising a shroud disposed in the housing extending along said catalyst combustor from an inlet opening to an outlet opening.

30. The non-bypassable catalyst assisted appliance of claim 27 wherein said automated secondary air control system comprises a bimetallic element.

* * * * *